US008250948B1

(12) United States Patent
Coffland

(10) Patent No.: US 8,250,948 B1
(45) Date of Patent: Aug. 28, 2012

(54) OPEN END WRENCH FOR ENGAGING A FACETED WORKPIECE

(75) Inventor: Donald W. Coffland, Seattle, WA (US)

(73) Assignee: The Boeing Company, Chicago, IL (US)

( * ) Notice: Subject to any disclaimer, the term of this patent is extended or adjusted under 35 U.S.C. 154(b) by 368 days.

(21) Appl. No.: 12/558,331

(22) Filed: Sep. 11, 2009

(51) Int. Cl.
*B25B 13/12* (2006.01)

(52) U.S. Cl. ..... 81/126; 81/179

(58) Field of Classification Search ..... 81/126–128, 81/111, 179
See application file for complete search history.

(56) References Cited

U.S. PATENT DOCUMENTS 3,921,475 A * 11/1975 Evans ..... 81/119
4,554,847 A 11/1985 DeSantis
4,637,284 A 1/1987 Rosenbaum
4,773,287 A 9/1988 Clarke
4,825,731 A 5/1989 Stojanowski
5,018,412 A 5/1991 Wylie, III
5,287,777 A 2/1994 Kolodziej
5,669,272 A * 9/1997 Hansen ..... 81/179
5,829,327 A * 11/1998 Stanton ..... 81/111
5,960,679 A 10/1999 Schultheis
6,223,630 B1 5/2001 Stanton
6,267,028 B1 * 7/2001 Macor ..... 81/119
6,523,440 B2 * 2/2003 Friedman et al. ..... 81/125.1
7,077,035 B1 7/2006 Huang

OTHER PUBLICATIONS

Snap-On Tools, Inc., Online Catalog web page, "Wrench, Crowfoot, Flare Nut, 5/8", 12-Point," available at <http://buy1.snapon.com/catalog/item.asp? P65=&tool=all&item_ID=2190&group_ID=267&store=snapon-store&dir=catalog>, last visited Sep. 11, 2009.
Snap-On Tools, Inc., Online Catalog web page, "Wrench, Combination, Short, 1/4", 12-Point," available at <http://buy1.snapon.com/catalog/item.asp? P65=&tool=hand&item_ID=4666&group_ID=11579&store=snapon-store&dir=catalog>, last visited Sep. 11, 2009.

* cited by examiner

*Primary Examiner* — Debra S Meislin
(74) *Attorney, Agent, or Firm* — Novatech IP Law

(57) ABSTRACT

A wrench for engaging a workpiece comprises a pair of fixed jaws and a pair of movable jaws being movable relative to the pair of fixed jaws. The workpiece includes a plurality of flats which may be adjoined at a plurality of corners. The pairs of fixed and movable jaws may be configured to engage the workpiece in at least one of a flat engaging position and a corner engaging position. The flat engaging position comprises the pairs of fixed and movable jaws being engaged to one of the flats on each one of the opposing sides of the workpiece. The corner engaging position comprises the pairs of fixed and movable jaws being engaged to an adjacent pair of the flats on each one of the opposing sides of the workpiece.

8 Claims, 16 Drawing Sheets

OPEN END WRENCH FOR ENGAGING A FACETED WORKPIECE

CROSS-REFERENCE TO RELATED APPLICATIONS (Not Applicable)

STATEMENT RE: FEDERALLY SPONSORED RESEARCH/DEVELOPMENT (Not Applicable)

FIELD

The present disclosure relates generally to hand tools and, more particularly, to tools for engaging fasteners installed in areas with limited overhead space and limited rotational space.

BACKGROUND

Limited access to fasteners is a common problem in many industries. In the aerospace industry, the problem of limited access to fasteners may be more pronounced due to more stringent engineering requirements and the tighter space constraints generally associated with aerospace structures. For example, aircraft commonly include hydraulic systems which including tubing sections that may be joined using flare nuts that are threadably engaged to in-line fittings. In order to provide leak-proof connection between the flare nut and the fittings, it is necessary to tighten the flare nuts to relatively high torque values. In addition, it is typically necessary to verify the torque values to which the flare nuts are tightened by using a torque wrench.

Because of the high torque levels that must be applied to flare nuts, it is desirable to use a wrench that provides a large amount of contact area between the wrench head and the flare nut. Typically, flare nuts have a hexagonal shape with six sides or flats adjoined at a corresponding number of corners. A wrench that applies rotational force to the flats of the flare nut may minimize the risk of damage to the corners which may otherwise become rounded if the wrench slips off of the flats during tightening of the flare nut. Certain wrenches such as socket wrenches and box end wrenches are configured to engage the flats of the flare nut. However, engagement of a socket wrench or a box end wrench to the flare nut requires access from the top or bottom of the flare nut which may not be possible due to the mounting of the flare nut on the tubing section.

Conventional open end wrenches allow for side engagement of the wrench to a fastener such as a flare nut. The wrench head of an open end wrench typically includes a pair of jaws having opposing parallel faces which are spaced at a distance to match the width of the flare nut measured across the flats. Ideally, the jaws are spaced to provide a generally snug or sliding fit with the flare nut such that rotational force from the wrench is applied to the flats instead of to the corners. However, manufacturing tolerances in the wrench and/or in the flare nut may result in a jaw spacing that may be greater than the width across the flats which may result in rounding off of the corners of the flare nut when large rotational force is applied to the flare nut.

Flare nut wrenches are a type of open end wrench that also allow for side engagement of a flare nut. Flare nut wrenches include a wrench head that is configured similar to a box end wrench with the exception that the wrench head includes a cutout on one side to allow the flare nut wrench to be slipped over a tubing section. Once the flare nut is slipped over the tubing section, the flare nut wrench may then be moved axially into engagement with the flats of the flare nut so that rotational force may be applied. Unfortunately, the cutout in the wrench head allows for the spreading apart of the wrench head when large rotational force is applied to the flare nut. Such spreading apart may result in slippage of the wrench head which may result in rounding off of the corners of the flare nut.

Limited rotational space is another challenge associated with fastener installations in confined spaces. In this regard, structure that is located adjacent to a fastener installation may limit the ability to rotate the fastener to the extent necessary to allow for progressive rotation of the fastener. For example, structure that is in close proximity to a flare nut installed on tubing may limit the ability to rotate the flare nut using conventional wrenches. In this regard, the adjacent structure may limit the repeated progressive rotation of the fastener to the extent necessary to tighten or loosen the fastener. Repeated progressive rotation of a fastener comprises engaging a wrench to one pair of flats of the fastener, rotating the fastener, disengaging the wrench head from the fastener, and then re-engaging the wrench to a different pair of flats to continue the rotation of the fastener in the same direction. Repeated progressive rotation of a six-sided flare nut using a conventional (i.e., non-offset) open end wrench requires a swing angle of no less then 60 degrees. In this regard, flare nut installations where adjacent structure limits rotation to less than 60 degrees would prevent rotation of the flare nut using conventional tools.

A further challenge associated with certain fastener installations is a requirement to maintain the wrench at a fixed orientation relative to a centerline or axis of the fastener. For example, when torquing a fastener to a desired torque level, it may be desirable to maintain the wrench at a perpendicular orientation relative to the fastener axis in order to provide an accurate indication of the level of torque that is being applied with a torque wrench. In this regard, certain industries restrict the use of torque wrenches where it is possible for the wrench head to engage the fastener in an off-axis or non-perpendicular orientation. Because conventional open end wrenches allow for off-axis orientation of the wrench head relative to the fastener, the use of open end torque wrenches may be limited.

As can be seen, there exists a need in the art for a wrench that permits side engagement of a fastener and which facilitates fastener rotation in locations having limited rotational space. Furthermore, there exists a need in the art for a wrench that facilitates repeated progressive rotation of fasteners within a minimal swing angle. Additionally, there exists a need in the art for a wrench wherein the wrench head is maintained in a perpendicular orientation relative to the fastener centerline. Finally, there exists a need in the art for a wrench having the above-described attributes and which is also of simple construction and of low cost.

SUMMARY

The above-noted needs associated with limited fastener access are specifically addressed and alleviated by the present disclosure which, in an embodiment, comprises a wrench for engaging a multi-faceted workpiece having a plurality of flats. The flats may be adjoined at a plurality of corners. The wrench may comprise a pair of fixed jaws and a pair of movable jaws which are movable relative to the pair of fixed jaws. The pair of fixed and movable jaws may be configured to engage the workpiece in at least one of a flat engaging position and a corner engaging position. The flat engaging position may comprise the pairs of the fixed and movable jaws being engaged to one of the flats on each one of opposing sides of the workpiece. The corner engaging position may comprise the pairs of the fixed and movable jaws being engaged to an adjacent pair of the flats on each one of the opposing sides of the workpiece.

Advantageously, the pair of movable jaws and the pair of fixed jaws of the wrench head facilitate side engagement to workpieces. Furthermore, the wrench head facilitates engagement to workpieces in locations where overhead access to the workpiece may be limited. In addition, the wrench head also facilitates engagement to workpieces wherein rotational space is limited. In this regard, the wrench head as disclosed herein represents an improvement over conventional wrenches which require access from above or below a workpiece in order to engage the workpiece and apply torque.

The wrench as disclosed herein also provides advantages over conventional wrenches such as standard open end wrenches which are limited to engagement to the flats of the workpiece. For example, for a workpiece configured as a hex-shaped fastener having six sides or flats, conventional open-end wrenches require a swing angle of at least 60 degrees in order to engage the wrench to the fastener, rotate the workpiece, disengage the wrench, and then re-engage the wrench to the fastener to continue the rotation. Advantageously, the wrench head as disclosed herein enables progressive continuous rotation of the workpiece where the swing angle is limited to 30 degrees. Offsetting the wrench head relative to the wrench handle may reduce the swing angle to 15 degrees for a six-sided fastener.

A further advantage associated with the wrench head as disclosed herein is the ability to securely engage the workpiece. In this regard, the fixed and movable jaws of the wrench may be configured such that rotation of the workpiece is prevented unless the wrench head is fully engaged to the workpiece. Even further, the wrench head may be configured such that engagement to the workpiece in the corner engaging position promotes a substantially perpendicular orientation of the handle axis relative to the workpiece axis or centerline.

The wrench as disclosed herein additionally provides the ability to apply torque to the workpiece in opposite directions without requiring removal of the wrench from the workpiece and flipping the wrench about the handle axis before rotating the workpiece in the opposite direction. The wrench head may also be configured to apply torque to the flats of the workpiece as opposed to certain open end wrenches which may apply torque to the corners of the workpiece. The wrench head as disclosed herein may have an outside envelope or profile that is within the envelope of a standard open end wrench head to facilitate access to fasteners in confined areas.

In an embodiment, the wrench may be configured to engage a workpiece having a plurality of flats joined at a plurality of corners. The wrench may comprise the pair of fixed jaws and the pair of movable jaws wherein the movable jaws are movable relative to the pair of fixed jaws. The pair of fixed and movable jaws may define the wrench opening which may be configured to engage the workpiece in the corner engaging position and preventing engagement of the workpiece in the flat engaging position. As indicated above, the flat engaging position may comprise the pairs of the fixed and movable jaws being engageable to one of the flats on each one of opposing sides of the workpiece. The corner engaging position may comprise the pairs of fixed and movable jaws being engageable to an adjacent pair of the flats on each one of the opposing sides of the workpiece.

A further embodiment of the wrench may comprise the wrench head having a fixed jaw set and a movable jaw set. The fixed jaw set may include opposing first and second fixed jaws respectively including inner and outer fixed lobes. The movable jaw set may be laterally movable relative to the fixed jaw set and may include opposing first and second movable jaws respectively including inner and outer movable lobes. The fixed and movable jaw sets may be configured to engage the workpiece in at least one of the flat engaging position and the corner engaging position.

The flat engaging position may comprise the inner fixed lobe and outer movable lobe being engageable to a single one of the flats on one of opposing sides of the wrench opening. The outer fixed lobe and inner movable lobe may be engageable to a single one of the flats on a side of the wrench opening opposite the inner fixed lobe and outer movable lobe. The corner engaging position may comprise the inner fixed lobe and outer movable lobe being engageable to respective ones of a pair of the flats adjoined by one of the corners on one of the opposing sides of the wrench opening. The outer fixed lobe and inner movable lobe may be engageable to respective ones of the pair of the flats adjoined by one of the corners on the side of the wrench opening opposite the inner fixed lobe and outer movable lobe.

In a further embodiment, disclosed is a methodology of rotating a workpiece having a plurality of flats. The method may comprise the steps of engaging the wrench head to the workpiece in the flat engaging position such that the wrench head is engaged to one of the flats on each one of opposing sides of the workpiece. The methodology may further comprise the step of rotating the wrench head in a first direction to cause the workpiece to be rotated. The methodology may further comprise engaging the wrench head to the workpiece in the corner engaging position such that the wrench head is engaged to an adjacent pair of the flats on each one of the opposing sides of the workpiece. The method may include rotating the wrench head in the first direction to cause the workpiece to be rotated.

In an embodiment, disclosed is a methodology of rotating a fastener having a plurality of flats adjoined at a plurality of corners. The methodology may comprise the steps of engaging the wrench head to the fastener in the flat engaging position such that the wrench head is engaged to one of the flats on each one of opposing sides of the fastener. The methodology may further comprise rotating the wrench head in a first direction to cause the fastener to be rotated through a swing angle. The wrench head may then be disengaged from the fastener and the wrench head may then be engaged to the workpiece in the corner engaging position such that the wrench head is engaged to an adjacent pair of the flats on each one of the opposing sides of the fastener. The methodology may include rotating the wrench head in the first direction to cause the fastener to be rotated through the swing angle.

The features, functions and advantages that have been discussed can be achieved independently in various embodiments of the present disclosure or may be combined in yet other embodiments, further details of which can be seen with reference to the following description and drawings below.

BRIEF DESCRIPTION OF THE DRAWINGS

These and other features of the present disclosure will become more apparent upon reference to the drawings wherein like numbers refer to like parts throughout and wherein.

DETAILED DESCRIPTION

Figure 1:
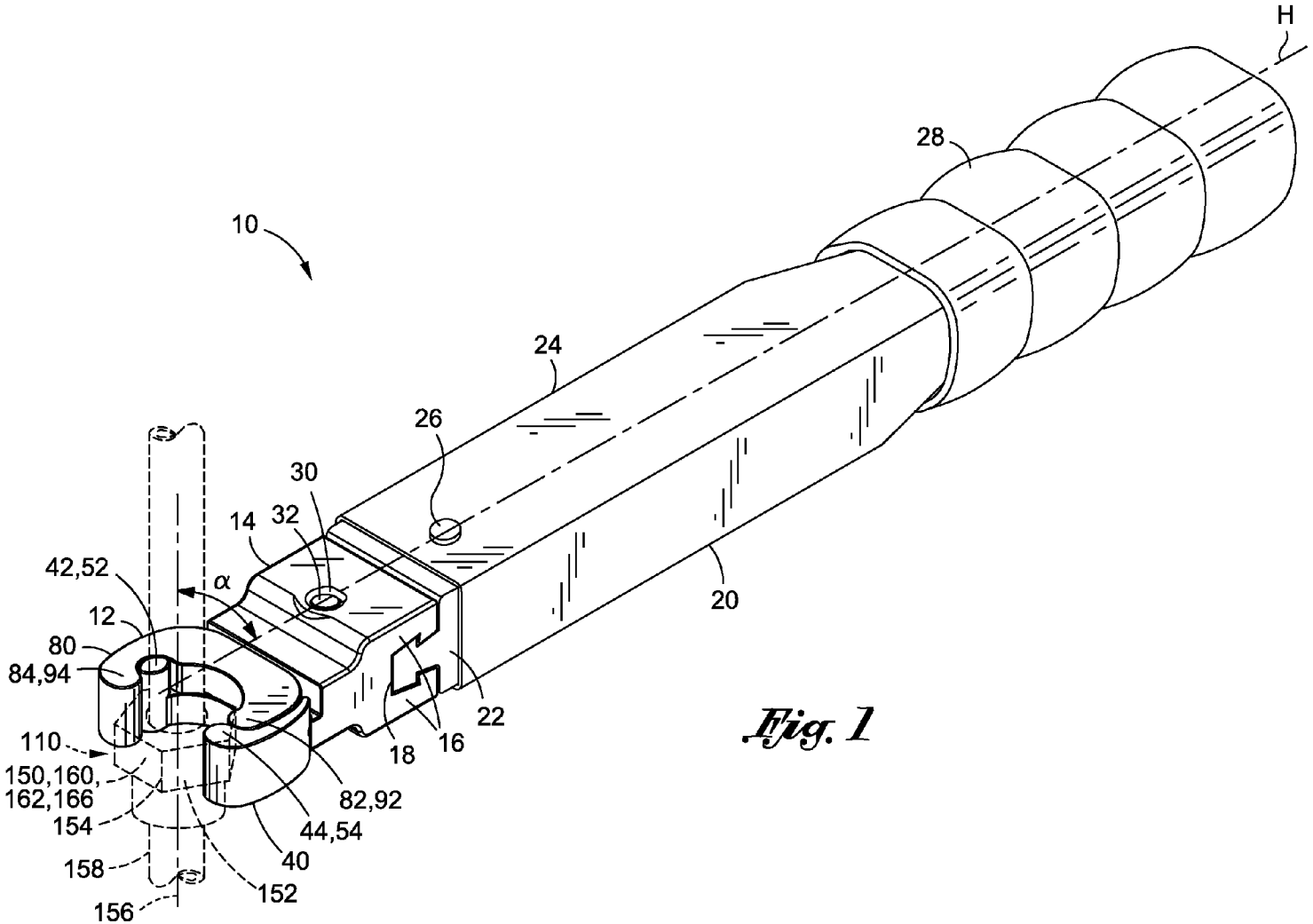
FIG. 1 is a perspective illustration of a wrench comprising a head portion having a handle extending outwardly therefrom and wherein the head portion is adapted for side engagement of a workpiece in a flat engaging position and/or a corner engaging position.
Figure 6:
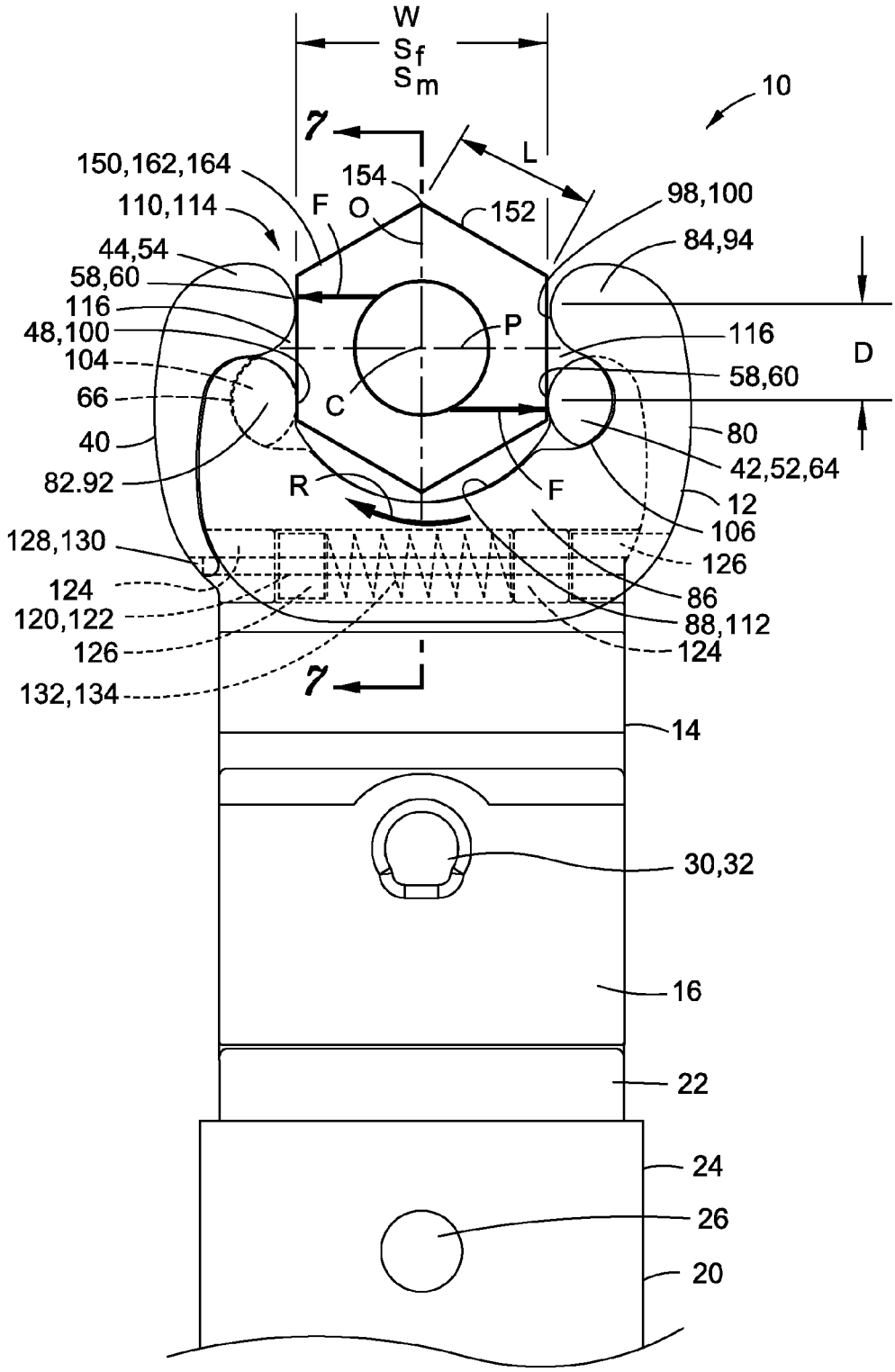
FIG. 6 is a front view of the head portion illustrating the wrench opening engaged to the workpiece in the flat engaging position.

Referring now to the drawings wherein the showings are for purposes of illustrating preferred and various embodiments of the disclosure only and not for purposes of limiting the same, shown in FIG. 1 is a perspective illustration of a wrench 10 as may be used for engaging a workpiece 150. The workpiece 150 may comprise a faceted member having at least one pair of opposing sides or flats 152 disposed on opposite sides of the workpiece 150. The workpiece 150 may comprise a variety of configurations including, but not limited to, polygonally-shaped members such as fasteners and including, but not limited to, hex-shaped fasteners commonly associated with nut and bolt head configurations as illustrated in FIG. 6. In this regard, the workpiece 150 may be provided in any configuration having any number of sides or flats 152. The flats 152 may be adjoined by a corresponding plurality of corners 154. The corners 154 of the workpiece 150 are not limited to sharp-edged corners 154 but may include rounded corners 154, beveled corners 154 and corners of any other shape or configuration. In a non-limiting example, the workpiece may comprise a four-sided workpiece having four flats adjoined by four corners. In a further non-limiting example, the workpiece may have an octagonal shape including eight flats adjoined by a corresponding quantity of corners.

As can be seen in FIG. 1, the wrench 10 may include a handle 20 extending outwardly from the wrench 10. The handle 20 may include a handle body 24 having a grip 28 formed on a free end of the handle body 24. The handle 20 may further include a handle fitting 22 to which the handle body 24 may be secured such as by using one or more handle fasteners 26 or by any other suitable connecting mechanism. In addition, the handle fitting, the handle body 24, the grip 28 or any combination thereof may be formed as a unitary structure. The handle 20 may comprise any suitable configuration that may be permanently or detachably secured to the wrench 10. In one embodiment, the wrench 10 may be configured as a torque wrench having a torque-measuring mechanism for indicating, measuring or otherwise applying torque to the workpiece 150 during rotation thereof by the wrench 10.

Figure 17A:
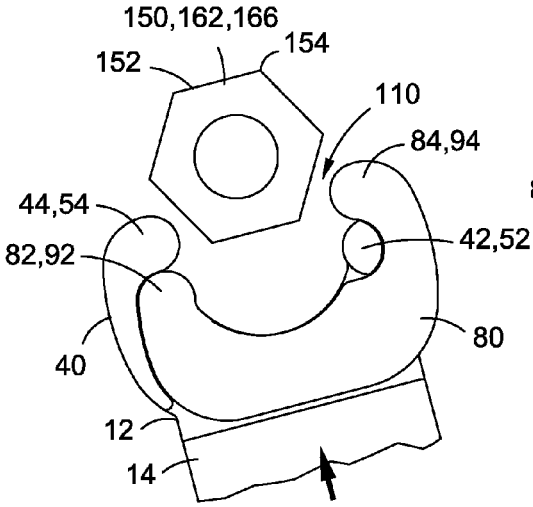
FIGS. 17A-17O are a series of front illustrations of the head portion illustrating a methodology of repeated progressive rotation of the workpiece by alternating between engagement of the workpiece in the corner engaging position and engagement of the workpiece in the flat engaging position.

As shown in FIG. 1, the wrench 10 may include a head portion 12 and a base portion 14. The base portion 14 may be configured to mount to the handle 20. The head portion 12 may include a fixed jaw set 40 comprising a pair of fixed jaws 42, 44 and a movable jaw set 80 comprising a pair of movable jaws 82, 84. The pairs of fixed and/or movable jaws 42, 44, 82, 84 may define a wrench opening 110 for engaging the workpiece 150. The movable jaw set 80 may be configured to be laterally movable relative to the fixed jaw set 40. In this regard, the movable jaw set 80 may be laterally movable along a direction that is generally perpendicular to an opening axis O of the wrench opening 110 as best seen in FIG. 6. Advantageously, the configuration of the movable and fixed jaw sets 80, 40 facilitates side engagement of the wrench opening 110 to the workpiece 150 as illustrated in FIG. 1. As can be seen in FIGS. 17A-17O and as described in greater detail below, the movable and fixed jaw sets 80, 40 are further configured to rotate the workpiece 150 in relatively small angular increments of swing angle θ as shown in FIG. 17E. In this regard, the wrench 10 provides a means for engaging fasteners in confined locations wherein the swing angle θ of the handle may be limited due to nearby structure.

Referring to FIG. 1, the head portion 12 may comprise the fixed jaw set 40 which includes opposing first and second fixed jaws 42*n* 44. The first fixed jaw 42 may include an inner fixed lobe 52. The second fixed jaw 44 may include an outer fixed lobe 54. In this regard, the inner and outer fixed lobes 52, 54 may be disposed in spaced relation to one another in a lateral direction and defining a fixed jaw spacing $S_f$ as shown in FIG. 6. Furthermore, the inner and outer fixed lobes 52, 54 may be disposed in staggered relation to one another wherein the outer fixed lobe 54 may protrude further from the base potion 14 than the inner fixed lobe 52.

Figure 4:
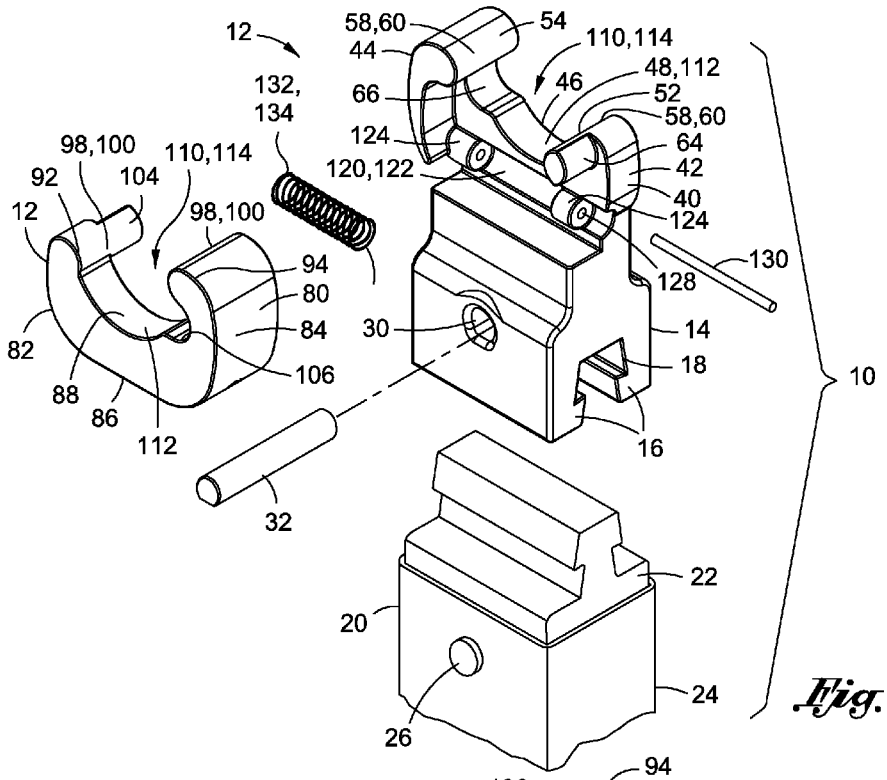
FIG. 4 is an exploded front perspective illustration of the head portion and a portion of the handle and illustrating the interconnectivity of the pairs of fixed and movable jaws.
Figure 5:
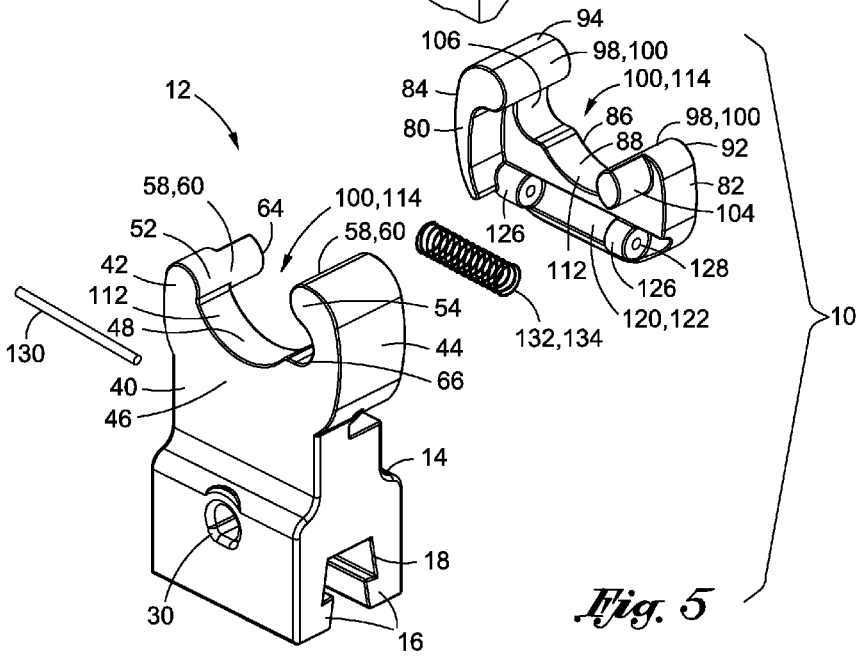
FIG. 5 is an exploded rear perspective illustration of the head portion further illustrating the interconnectivity of the fixed and movable jaws.

Likewise, as can be seen in FIG. 1, the movable jaw set 80 may include the opposing pair of first and second movable jaws 82, 84. The first movable jaw 82 may include the inner movable lobe 92. The second movable jaw 84 may include an outer movable lobe 94. The first and second movable jaws 82, 84 are disposed in laterally-spaced relation to one another and defining a movable jaw spacing $S_m$ as shown in FIG. 6. Likewise, the first and second movable jaws 82, 84 may be disposed in staggered relation to one another and defining a fixed jaw spacing $S_f$. The staggered relation of the first and second movable jaws 82, 84 may be opposite to the configuration of the staggered relation of the first and second fixed jaws 42, 44 as shown in FIGS. 4-5. In this regard, the fixed jaw set 40 may optionally be formed in substantially identical configuration to the movable jaw set 80 as shown in FIGS. 4-5. The movable jaw set 80 may be oriented in mirror image to the fixed jaw set 40 with the fixed and movable jaw sets 40, 80 being disposed in facing relation to one another.

Figure 2:
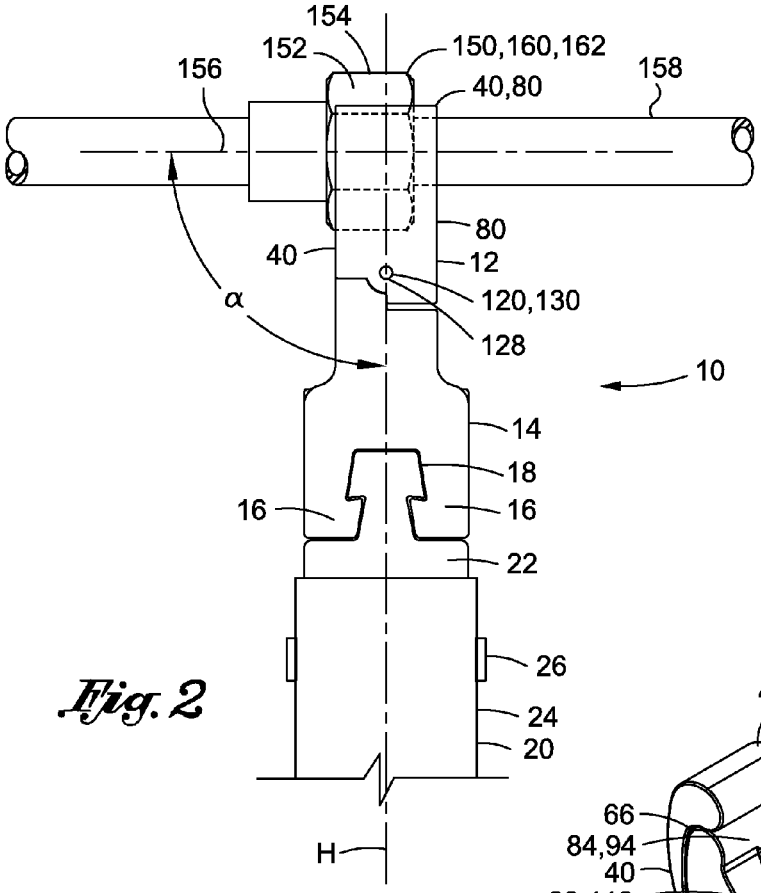
FIG. 2 is a side illustration of the head portion engaged to a workpiece wherein the handle axis of the wrench is maintained at a wrench orientation angle relative to the workpiece axis.

Referring to FIG. 2, shown is a side illustration of the wrench 10 engaged to the workpiece 150. The workpiece 150 is illustrated as a hex-shaped fastener 162 having six flats 152 adjoined by six corresponding corners 154 and may be configured as a flare nut 160 similar to that which may be used in tubing installations. In the illustration of FIG. 2, the flare nut 160 is shown as being installed on a segment of tubing 158. The workpiece 150 defines a workpiece axis 156 extending transversely through the workpiece 150 such as along the centerline of the workpiece 150. The wrench 10 can be seen as having a handle axis H extending lengthwise or longitudinally through the wrench 10 and intersecting the workpiece axis 156 at a wrench orientation angle α. In an embodiment, the wrench 10 may be configured such that the wrench orientation angle α is substantially perpendicular to the workpiece axis 156 as illustrated in FIG. 2.

Figure 9:
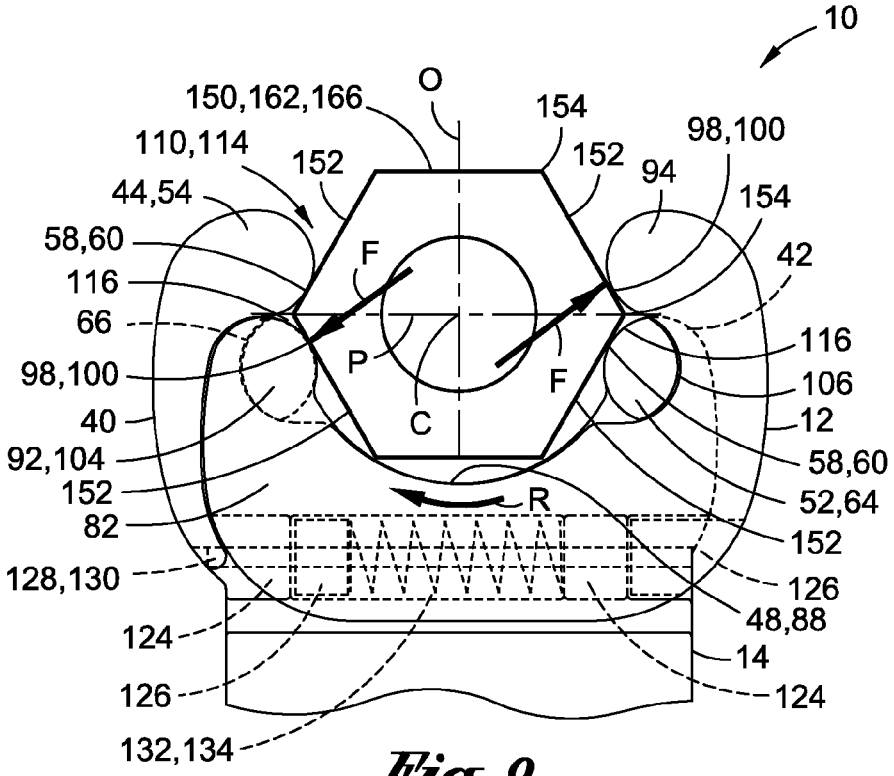
FIG. 9 is a front illustration of the head portion illustrating engagement of the pairs of fixed and movable jaws to the workpiece and further illustrating inner and outer fixed and movable lobes of respective ones of the fixed and movable jaws and further illustrating rounded engagement areas of the lobes for engaging the workpiece.
Figure 16:
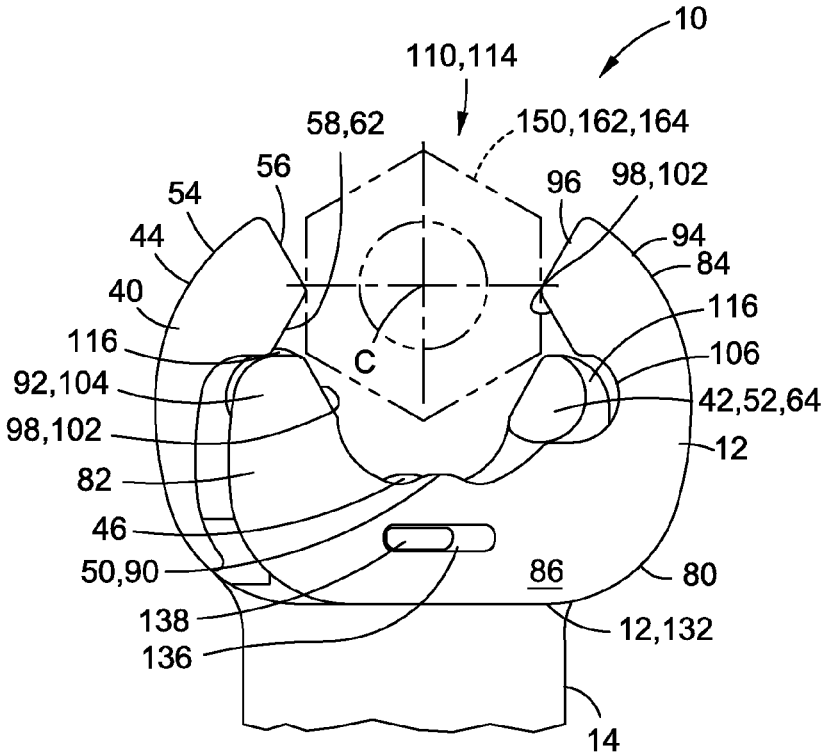
FIG. 16 is a front illustration of the head portion illustrating the fixed and movable jaws preventing engagement of the workpiece in the flat engaging position.

In this regard, the wrench 10, in an embodiment, may be configured to engage the workpiece 150 in a corner engaging position 166 wherein engagement of the wrench 10 across the corners 154 as shown in FIG. 9 may be achieved when the wrench 10 is oriented at substantially 90 degrees (i.e., perpendicular) relative to the workpiece axis 156 as shown in FIG. 2. Furthermore, engagement of the wrench 10 to the workpiece 150 in the corner engaging position 166 may be maintained by limiting the orientation of the handle axis H (FIG. 1) to a substantially perpendicular orientation relative to the workpiece axis 156. It may be appreciated that if the axis H of the handle 20 were oriented at a non-perpendicular angle relative to the axis 156 of the nut 160, such as at a 45 degree angle, then a pair of the opposing corners 154 of the nut 160 (e.g., in the embodiment shown, the nut 160 has six (6) corners 154 that define the six (6) flats 152) would not be able to nest within the notch 116 (FIG. 9) between the lobes 52, 54, 92, 94 (FIG. 9). Instead, the corners 154 of the nut 160 would be oriented at an angle to the notch 116 which would prevent the lobes 52, 54, 92, 94 from engaging the corners 154 of the nut 160. In this regard, the wrench 10 as disclosed herein promotes perpendicular engagement of the head portion 12 to the workpiece 150. As was earlier mentioned, a perpendicular orientation of the wrench 10 relative to the workpiece 150 may facilitate the use of a torque wrench for accurate application of a predetermined torque value to the workpiece 150. In addition, the wrench 10 may be configured to prevent engagement of the head portion 12 to the workpiece 150 when the head portion 12 is oriented in a non-perpendicular relation to the workpiece axis 156 as illustrated in FIG. 16 and described in greater detail below.

Figure 3:
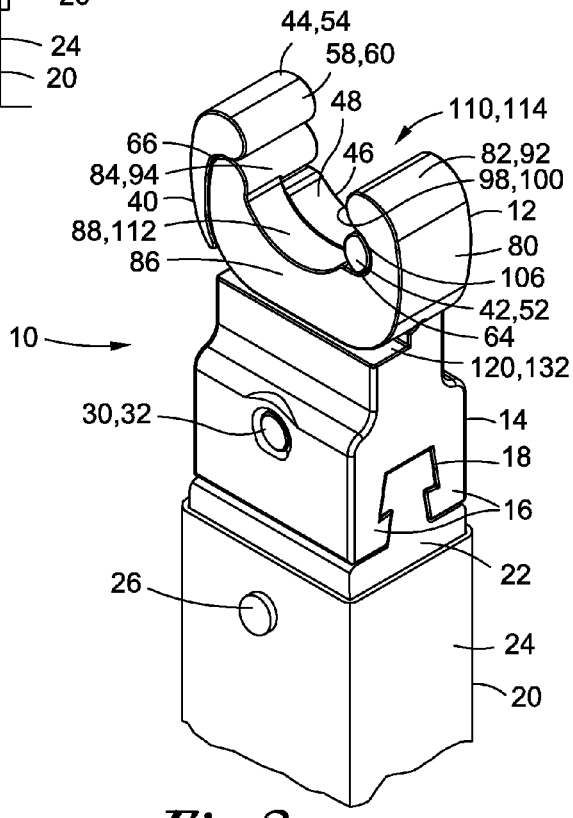
FIG. 3 is a perspective illustration of an embodiment of the head portion comprised of a pair of fixed jaws and a pair of movable jaws and illustrating the handle being configured to be removable from the head portion.

Referring still to FIG. 2, the wrench 10 can be seen as including a handle 20 having the handle body 24 and a handle fitting 22 optionally attached thereto such as via a handle fastener 26. The handle fitting 22 may be coupled to the base portion 14 by any suitable means. For example, the handle fitting 22 may include a tongue for engagement into a base groove 18 that may be formed by an opposing pair of base flanges 16 of the base portion 14. The handle fitting 22 may be insertable into the base groove 18 and may be retained therewithin by any suitable means including, but not limited to, a retaining mechanism 32 such as a quick release pin extending through a flange bore 30 as illustrated in FIG. 3. However, the retaining mechanism 32 may be configured in any suitable arrangement for securing the handle 20 to the base portion 14. In addition, the handle 20 may be permanently or non-detachably secured to the base portion 14.

Referring to FIG. 3, shown is a perspective illustration of the wrench 10 wherein the head portion 12 of the wrench 10 may be comprised of the fixed jaw set 40 and the movable jaw set 80. As was earlier mentioned, the movable jaw set 80 may be laterally movable relative to the fixed jaw set 40. In this regard, the movable jaw set 80 may be slidably connected to the fixed jaw set 40. The fixed jaw set 40 may be integrally formed with the head portion 12 which, as illustrated in FIG. 3, may include the base portion 14. The fixed jaw set 40 may also be detachable securable to the base portion 14 and being generally non-movable when secured to the base portion 14. The fixed jaw set 40 and movable jaw set 80 may cooperate to engage the workpiece 150 in the flat engaging position 164 as shown in FIG. 6 and/or in the corner engaging position 166 as shown in FIG. 9 and as described in greater detail below. The fixed jaw set 40 may comprise the first and second fixed jaws 42, 44 which may be integrally connected by a fixed jaw web 46. Likewise, the movable jaw set 80 may comprise the first and second movable jaws 82, 84 which may be interconnected by a movable jaw web 86.

Referring to FIG. 4, shown is an exploded perspective illustration of the wrench 10 comprising the handle 20 which may be securable to the head portion 12. As was earlier described, the fixed jaw set 40 may comprise the first and second fixed jaws 42, 44 which may respectively include the inner and outer fixed lobes 52, 54. Likewise, the movable jaw set 80 may comprise the first and second movable jaws 82, 84 which may respectively include the inner and outer movable lobes 92, 94. The first fixed jaw 42 may comprise the inner fixed lobe 52 which may include a lobe extension 64. In this regard, the inner fixed lobe 52 may extend at least partially across the second movable jaw 84 or outer movable lobe 94. The second movable jaw 84 may include a recess 106 which may be sized and configured to receive the lobe extension 64 of the inner fixed lobe 52. Likewise, the second fixed jaw 44 may include a recess 66 which may be sized and configured to receive a lobe extension 104 of the inner movable lobe 92 of the first movable jaw 82.

The inner and outer fixed lobes 52, 54 and inner and outer movable lobes 92, 94 may be of equivalent width in order to maximize contact area of the lobes to the workpiece 150. However, the inner and outer fixed lobe 52, 54 and inner and outer movable lobes 92, 94 may be provided in dissimilar widths or in any combination of similar and dissimilar widths. The fixed jaw set 40 may be movably coupled to the movable jaw set 80 by any suitable means without limitation. For example, the fixed jaw set 40 may be movably coupled to the movable jaw set 80 by a sliding mechanism 120 disposed between the fixed and movable jaw sets 80, 40. As can be seen in FIG. 4, in a non-limiting example, the sliding mechanism 120 may comprise a web groove 122 wherein a portion of the movable jaw set 80 may be engageable with the fixed jaw set 40 such that loads may be transferred between the fixed and movable jaw sets 40, 80 during rotation of the workpiece 150.

Shown in FIG. 5 is an interior portion of the movable jaw set 80 which, in an embodiment, may be substantially identical to an interior portion of the fixed jaw set 40 shown in FIG. 4. The sliding mechanism 120 of the wrench 10 may be formed in any one of a variety of shapes, sizes and configurations for coupling the movable and fixed jaw sets 40, 80. For example, as shown in FIGS. 4-5, the sliding mechanism 120 may comprise substantially identical configurations of the web groove 122 formed within each one of the movable jaw web 86 and fixed jaw web 46. In this regard, each one of the fixed and movable jaw webs 46, 86 may include respective fixed and movable bosses 124, 126 which may be formed complementary to the web groove 122 and which may be engageable within the web groove 122.

The fixed and movable jaw sets 40, 80 may be coupled together by means of a shaft 130 which may be extended through a bore 128 formed through the movable and fixed bosses 126, 124. The shaft 130 may be configured to facilitate slidable engagement of the movable jaw set 80 to the fixed jaw set 40. In addition, the shaft 130 may facilitate load transfer from the movable jaw set 80 to the base portion 14. As mentioned above, the sliding mechanism 120 may comprise any suitable configuration that facilitates lateral movement of the movable jaw set 80 relative to the fixed jaw set 40.

Referring still to FIGS. 4 and 5, the head portion 12 may further comprise a biasing mechanism 132 which may be integrated into the head portion 12 in order to urge or bias the movable jaw set 80 into alignment with the fixed jaw set 40. For example, the biasing mechanism 132 may be configured as a compression spring 134 which may be installed between the respective ones of the fixed boss 124 and movable boss 126. The biasing mechanism 132 may be configured to prevent uncontrolled lateral movement of the movable jaw set 80 such as when engaging the workpiece 150. However, it is contemplated that the biasing mechanism 132 may be altogether omitted from the head portion 12.

Referring to FIG. 6, shown is a front view of the wrench 10 wherein the pairs of fixed and movable jaws 42, 44, 82, 84 are engaged to the workpiece 150 in the flat engaging position 164. As can be seen, each one of the fixed and movable jaw sets 40, 80 may have a generally crescent or U-shaped configuration. However, the first and second jaws 42, 44 of the fixed jaw set 40 may be provided in any configuration wherein the inner and outer fixed lobes 52, 54 are formed in staggered relation to one another and defining a fixed jaw spacing $S_f$ relative to one another. Likewise, the movable jaw set 80 may comprise any configuration of the first and second movable jaws 82, 84. The first and second movable jaws 82, 84 may include respective inner and outer movable lobes 92, 94. In this regard, the inner and outer movable lobes 92, 94 are preferably disposed in staggered relation to one another defining a movable jaw spacing $S_m$. In addition, as shown in FIG. 6, the inner and outer movable lobes 92, 94 may be disposed in opposite arrangement to the staggered relation of the inner and outer fixed lobes 52, 54. The inner and outer movable lobes 92, 94 may also define a movable jaw spacing $S_m$ that may be substantially equivalent to the fixed jaw spacing $S_f$. Even further, the fixed jaw spacing $S_f$ and movable jaw spacing $S_m$ may be substantially equivalent to a width W measured across opposing flats 152 of the workpiece 150.

Referring still to FIG. 6, shown is the wrench 10 engaged to the workpiece 150 in the flat engaging position 164 wherein the inner fixed lobe 52 and outer movable lobe 94 are engaged to a single one of the flats 152 on one of opposing sides of the wrench opening 110. Likewise, the outer fixed lobe 54 and the inner movable lobe 92 are shown engaged to a single one of the flats 152 on a side of the wrench opening 110 that is opposite the inner fixed lobe 52 and outer movable lobe 94. In the configuration shown, the wrench opening 110 is defined by the adjacent pairs of lobes 52, 54, 92, 94 disposed on opposing sides of the wrench opening 110. The distance D between adjacent pairs of lobes on at least one of opposing sides of the wrench opening 110 is preferably no greater than the length L of one of the flats 152. In this regard, the distance D is preferably such that the adjacently disposed lobes are engageable to the single one of the flats 152 on opposing sides of the workpiece 150.

As can be seen in FIG. 6, the spacing between the adjacently disposed lobes 52, 54, 92, 94 on each one of opposing sides of the workpiece 150 may be dictated in part by the shape of each one of the engagement areas 58, 98 formed on each one of the inner and outer fixed and movable lobes 52, 54, 92, 94. For example, as shown in FIG. 6, the engagement areas 58, 98 of each one of the inner and outer fixed and movable lobes 52, 54, 92, 94 in contact with the workpiece 150 may have a rounded surface 60, 100 configuration. In this configuration, each one of the inner and outer fixed and movable lobes 52, 54, 92, 94 may preferably be engaged to the flat 152 of the workpiece 150 in a line contact extending across the width of the inner and outer fixed and movable lobes 52, 54, 92, 94. During rotation of the wrench 10 along a direction of rotation indicated by the reference character R, a reactive force at the arrows designated by reference character F may be generated between the inner fixed lobe 52 and the outer fixed lobe 54 and the workpiece 150.

Conversely, rotation of the wrench 10 about the workpiece 150 in a direction opposite the indicated direction of rotation R would result in a reactive force F at the inner movable lobe 92 and outer movable lobe 94. As may be appreciated, greater leverage may be exerted on the workpiece 150 by spacing the contact areas of the adjacent lobes at greater distances from one another. The contact areas of the lobes may spaced at a maximum distance of no greater than a length L of one of the flats 152 as shown in FIG. 6. Each one of the fixed and movable jaw sets 40, 80 preferably includes sufficient clearance for receiving the workpiece 150 in the flat engaging position 164 as shown in FIG. 6 without interference between the workpiece 150 and the web interior surfaces 48, 88 of respective ones of the fixed jaw web 46 and movable jaw web 86.

Referring still to FIG. 6, the fixed and movable jaw sets 40, 80 are preferably also configured such that a center C of the workpiece 150 occupies or is aligned with a center C of the wrench opening 110. In this regard, the center of the wrench opening 110 may be coincident with the intersection of the opening axis O and a line P extending perpendicularly through the center of the workpiece 150 and bisecting the distance D between the adjacent pairs of lobes on opposing sides of the workpiece 150. However, it is contemplated that the fixed and movable jaw sets 40, 80 may be configured such that the workpiece 150 may be engageable into the wrench opening 110 without regard to alignment of the workpiece 150 with the center of the wrench opening 110.

Figure 7:
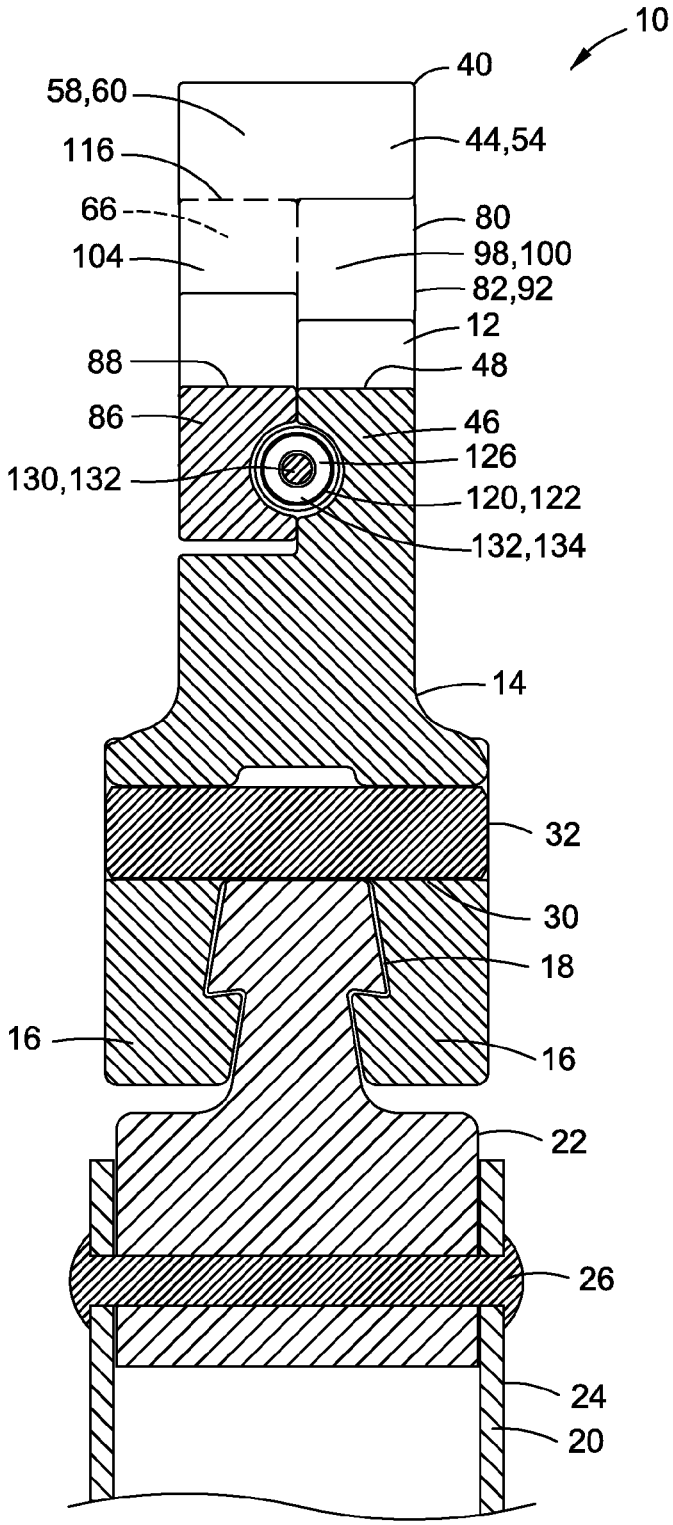
FIG. 7 is a cross-sectional illustration of the head portion taken along line 7-7 of FIG. 6 and illustrating the interconnectivity of the head portion to the handle and further illustrating a sliding mechanism interconnecting the fixed jaws to the movable jaws

Referring to FIG. 7, shown is a cross-sectional illustration of the wrench 10 and handle 20 taken along line 7-7 of FIG. 6 and illustrating the interconnectivity of the various components thereof. As can be seen in FIG. 7, the handle 20 may include a handle body 24 which may be provided in any suitable configuration. For example, the handle 20 may be configured as an elongate member which may be generally hollow or tubular and which may be permanently attached to the handle fitting 22 which may, in turn, be received within the base groove 18 of the base portion 14. The handle body 24 may be secured in permanent fashion to the handle fastener 26 illustrated in FIG. 7 or by any other suitable means. Alternatively, the handle fitting 22 may be integrally formed with the handle body 24 and may extend along a length thereof to a free end of the handle 20 which may include the grip 28 as shown in FIG. 1.

Referring still to FIG. 7, the base portion 14 may be integrally connected to the fixed jaw set 40. The movable jaw set 80 may be slidably connected to the fixed jaw set 40 by means of the sliding mechanism 120 as described above with reference to FIGS. 4-5. In this regard, the sliding mechanism 120 may comprise mating web grooves 122 which may collectively define an interior cavity for housing the biasing mechanism 132. The biasing mechanism 132 may be configured in any suitable arrangement or configuration. For example, as illustrated in FIGS. 4 and 5, the biasing mechanism 132 may be configured as a compression spring 134. In this regard, the biasing mechanism 132 may be configured to urge the first and second movable jaws 82, 84 into alignment with the first and second fixed jaws 42, 44 to facilitate engagement of the head portion 12 to the workpiece 150 in the flat engaging position 164. In addition, the biasing mechanism 132 may facilitate engagement of the first and second movable jaws 82, 84 to the workpiece 150 in the corner engaging position 166.

Figure 8:
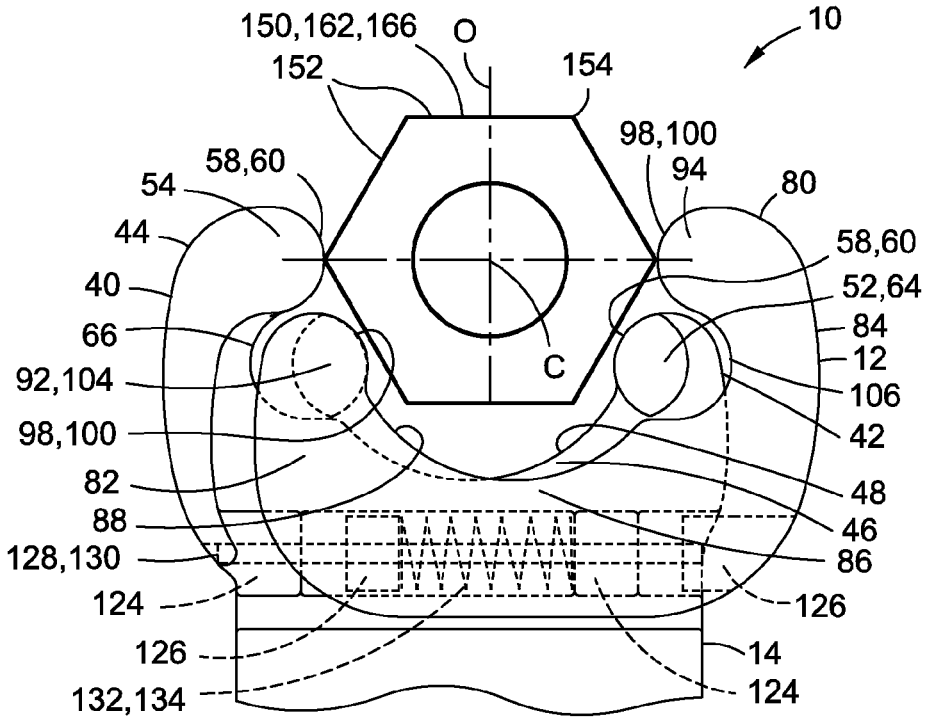
FIG. 8 is a front illustration of the head portion illustrating lateral movement of the pair of movable jaws in relation to the pair of fixed jaws during engagement of the workpiece in the corner engaging position.

Referring to FIG. 8, shown is the head portion 12 during engagement of the fixed and movable jaw sets 40, 80 to the workpiece 150 in the corner engaging position 166. As can be seen, the movable jaw set 80 may be movable laterally relative to the fixed jaw set 40 in order to accommodate the wider span of the workpiece 150 measured across opposing corners 154 of the workpiece 150 during entry of the workpiece 150 into the wrench opening 110. Lateral movement of the movable jaw set 80 may be facilitated by means of the sliding mechanism 120 wherein the movable bosses 126 may be slidably engageable to or movable along the web groove 122 formed within the fixed jaw web 46 as described above with reference to FIGS. 4 and 5. Likewise, the fixed bosses 124 of the fixed jaw set 40 may also be movably engageable to the web groove 122 formed in the movable jaw web 86.

Referring to FIGS. 8 and 9, the biasing mechanism 132 may urge the outer movable lobe 94 of the second movable jaw 84 along a direction back toward the outer fixed lobe 54 as the workpiece 150 enters the wrench opening 110. More specifically, as the outer movable lobe 94 passes over the corner 154 of the workpiece 150, the biasing mechanism 132 maintains the outer movable lobe 94 in contacting relation with the workpiece 150. As the workpiece 150 is received into the wrench opening 110, the opposing corners 154 of the workpiece 150 enter an opposing pair of notches 116 formed between the outer movable lobe 94 and inner fixed lobe 52 on one side of the wrench opening 110 and the outer fixed lobe 54 and inner movable lobe 92 on the opposite side of the wrench opening 110.

Referring to FIG. 9, shown is the wrench 10 engaged to the workpiece 150 in the corner engaging position 166. As can be seen, the inner fixed lobe 52 and the outer movable lobe 94 are engageable to respective ones of a pair of the flats 152 on one side of the wrench opening 110. The pair of flats 152 may be adjoined by one of the corners 154 on one side of the workpiece 150. Likewise, the outer fixed lobe 54 and inner movable lobe 92 may be engaged to respective ones of a pair of the flats 152 that may be adjoined by one of the corners 154 on an opposite side of the wrench opening 110. In the corner engaging position 166, application of rotational force to the head portion 12 along a direction of rotation R in FIG. 9 may be reacted at the arrows indicated by reference character F. Conversely, rotation of the head portion 12 in a direction opposite to the direction of rotation may result in a reactive force at the outer fixed lobe 54 and inner fixed lobe 52.

As may be appreciated, the wrench 10 configuration as disclosed herein may facilitate rotation of the workpiece 150 in either one of opposing rotational directions. For example, referring briefly to FIG. 6, engagement of the head portion 12 to the workpiece 150 in the flat engaging position 164 may facilitate the application of rotation and torque in the rotation direction R illustrated in FIG. 6 or in an opposite rotational direction. Likewise, referring to FIG. 9, engagement of the head portion 12 to the workpiece 150 in the corner engaging position 166 may facilitate the application of rotation and torque to the workpiece 150 in either one of opposing rotational directions. In this regard, the head portion 12 may facilitate loading of the workpiece 150 across the flats 152 at a location adjacent the corners 154 of the workpiece 150 and in either one of opposing rotational directions.

Referring briefly to FIG. 2, a further advantage associated with the wrench 10 of the present disclosure is related to the engagement of the head portion 12 to the workpiece 150 wherein the handle axis H may be maintained at a wrench orientation angle $\alpha$ that is substantially perpendicular relative to the workpiece axis 156. More particularly, the wrench 10 may be configured such that orientation of the head portion 12 in a non-perpendicular relation to the workpiece axis 156 prevents engagement of the head portion 12 to the workpiece 150 in the corner engaging position 166 as shown in FIG. 9. As mentioned above, the perpendicular orientation of the head portion 12 relative to the workpiece axis 156 provides a means to verify full engagement of the head portion 12 to the workpiece 150. For example, the fixed and movable jaw sets 40, 80 may be configured such that engagement of the workpiece 150 in the corner engaging position 166 may be achieved when the handle axis H is oriented substantially perpendicularly relative to the workpiece axis 156 as shown in FIG. 2. Furthermore, continued engagement of the head portion 12 to the workpiece 150 in the corner engaging position 166 may be dependent upon maintaining the handle axis H at a substantially perpendicularly orientation relative to the workpiece axis 156 during rotation of the workpiece 150. In this manner, the head portion 12 prevents off-axis engagement to the workpiece 150 which advantageously facilitates accurate application of a predetermined torque value to the workpiece 150.

A further advantage provided by an embodiment of the wrench 10 as disclosed herein includes a reduction in the wrench swing angle $\theta$ as compared to the swing angle associated with conventional open end wrenches. As a result of the capability to engage the workpiece 150 in the flat engaging position 164 and the corner engaging position 166, the workpiece 150 may be rotated in relatively small angular increments or through a relatively small swing angle θ. The minimum swing angle θ may be defined by the following formula:

$$\theta=360 \text{ degrees}/2*N$$

wherein N represents the total quantity of flats 152 of the workpiece 150. For a six-sided or hexagonally-shaped workpiece 150 having six flats 152, the workpiece 150 may be rotated in angular increments as small as 30 degrees. For a four-sided or square-shaped workpiece 150 having four flats 152, the minimum swing angle θ provided by the wrench 10 as disclosed herein is 45 degrees. Likewise, for an eight-sided figure having eight flats 152, the minimum swing angle θ is 22.5 degrees. The minimum swing angle θ may be further reduced by incorporating angular offset into the head portion 12.

Figure 10:
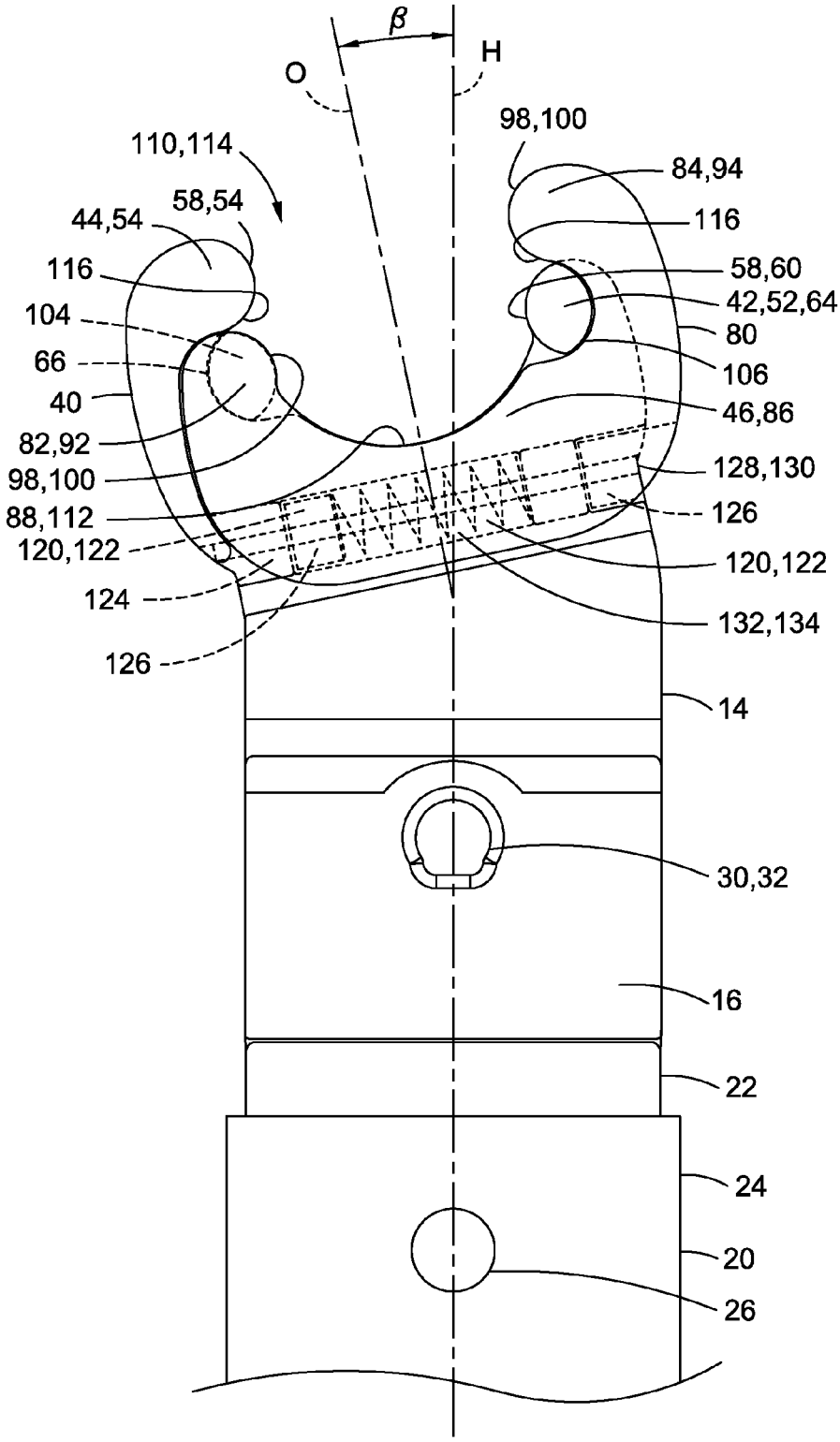
FIG. 10 is a front illustration of a head portion in an embodiment wherein the opening axis of the head portion is angularly offset relative to the handle axis of the wrench.

For example, referring briefly to FIG. 10, shown is a front view of the wrench 10 wherein the head portion 12 is angularly offset relative to the handle axis H by an amount represented by the head offset angle β. As can be seen in FIG. 10, the wrench opening 110 defines the opening axis O which may extend through a center C of the wrench opening 110. The swing angle θ may be reduced by angularly offsetting the opening axis O relative to the handle axis H. The angular offset of the head portion 12 facilitates rotation of the workpiece 150 in locations with limited rotational space. The wrench opening 110 may be angularly offset relative to the handle axis H by an amount no greater than the head offset angle β which may be defined by the following:

$$\beta=360 \text{ degrees}/8*N$$

wherein N represents the total quantity of flats 152 of the workpiece 150. For example, for a hexagonally-shaped workpiece 150 having six flats 152, the head offset angle β is 7.5 degrees. By including the angular offset into the head portion 12, the swing angle θ may be reduced by 50% relative to a non-offset configuration wherein the minimal swing angle is limited to 30 degrees for a hexagonally-shaped workpiece 150. However, by incorporating a head offset angle β of 7.5 degrees in the head portion 12, the swing angle is reduced to 15 degrees. In this regard, the angular offset head permits rotation of workpieces in installations allowing as little as 15 degrees of rotation.

As is known in the art, rotation of a workpiece 150 using an offset wrench 10 comprises engaging the wrench 10 to the workpiece, rotating the workpiece 150 through the swing angle θ, disengaging the wrench 10 from the workpiece, flipping the wrench 180 degrees about the handle axis H, re-engaging the wrench 10 to the workpiece 150 and rotating the workpiece 150 in the same direction. A similar procedure may be applied with regard to an offset configuration of the head portion 12 as illustrated in FIG. 10. In this regard, rotation of an offset configuration of the wrench 10 may comprise engaging the workpiece in a flat engaging position, rotating the workpiece through the swing angle, disengaging the wrench 10 from the workpiece, flipping the wrench 180 degrees about the handle axis H, re-engaging the wrench 10 to the workpiece in the flat engaging position, and rotating the workpiece through the swing angle. The wrench 10 may then be re-engaged to the workpiece in the corner engaging position and above-described steps for rotating the workpiece may be repeated including the step of flipping the wrench 180 degrees about the handle axis H.

Figure 11:
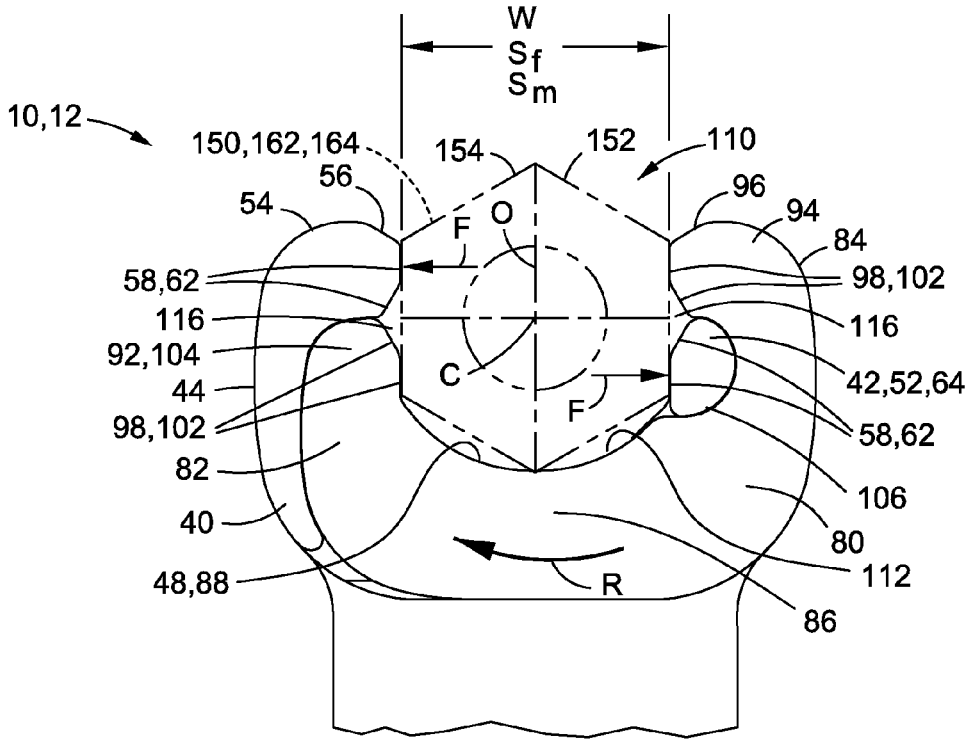
FIG. 11 is a front illustration of the head portion illustrating the engagement areas of the lobes being formed as planar surfaces for engaging the workpiece.

Referring to FIG. 11, shown is a front view of the head portion 12 illustrating the inner and outer fixed lobes 52, 54 and inner and outer movable lobes 92, 94 engaged to the workpiece 150 in the flat engaging position 164. As can be seen in FIG. 11, each one of the inner and outer fixed and movable lobes 52, 54, 92, 94 includes engagement areas 58, 98 wherein the lobes may be in contact with the workpiece 150. At least one of the engagement areas 58, 98 of the lobes may be formed as planar surfaces 62, 102. It should also be noted that the engagement areas 58, 98 are not limited to the planar surface 62, 102 configuration shown in FIG. 11 or the rounded surface 60, 100 configuration shown in FIGS. 1-10. In this regard, each one of the engagement areas 58, 98 of the inner and outer fixed and movable lobes 52, 54, 92, 94 may be formed in any size, shape or configuration. The shape of the engagement areas 58, 98 may be formed complementary to the shape of the workpiece 150. For example, the planar surfaces 62, 102 shown in FIG. 11 may be formed complementary to the flats 152 of the workpiece 150 in the flat engaging position 164.

Figure 12:
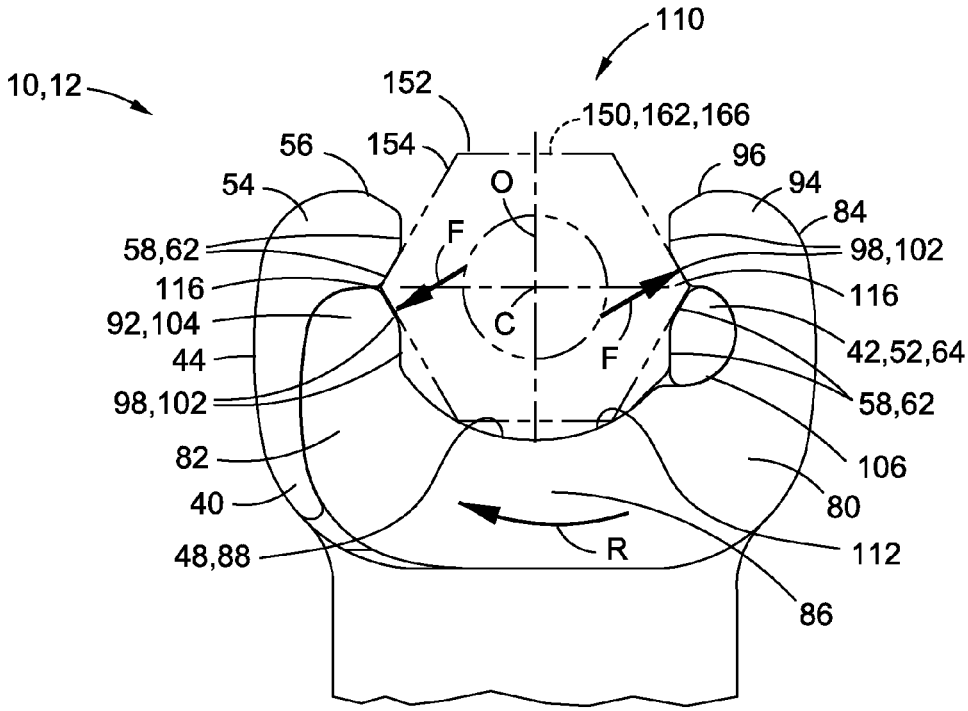
FIG. 12 is a front illustration of the head portion illustrating the planar surfaces engaging the workpiece in the corner engaging position.

Referring still to FIG. 11, at least one of the lobes may include one or more planar surfaces 62, 102 that may be angled relative to the planar surfaces 62, 102 of the adjacent lobe such that fixed and movable jaw sets 40, 80 may engage the workpiece 150 in the corner engaging position 166 and/or in the flat engaging position 164. For example, as shown in FIGS. 11 and 12, each one of the lobes may include a pair of planar surfaces 62, 102 for engagement of the flats 152 of the workpiece 150 in either the corner engaging position 166 or the flat engaging position 164. Advantageously, the planar surfaces 62, 102 increase the contact surface area between the inner and outer fixed and movable lobes 52, 54, 92, 94 and the flats 152. In addition, by providing the inner and outer fixed and movable lobes 52, 54, 92, 94 with planar surfaces 62, 102 as shown in FIGS. 11-12 as opposed to the rounded surfaces 60,100 illustrated in FIGS. 1-10, contact between the inner and outer fixed and movable lobes 52, 54, 92, 94 and the flats 152 may occur at a greater distance from the corners 154 of the flats 152. For example, as can be seen in FIG. 12, a portion of the planar surface 102 of the outer movable lobe 94 is spaced a greater distance away from the corner 154 of the workpiece 150 as compared to FIG. 9 wherein the rounded surface 100 of the lobe results in a line contact between the lobe and the flat 152. As may be appreciated, the engagement areas 58, 98 of each one of the inner and outer fixed and movable lobes 52, 54, 92, 94 may be provided in any suitable size, shape and configuration and are not limited to the particular sizes, shapes and configurations illustrated in the Figures. For example, the engagement areas 58, 98 may be formed complementary to the workpiece 150.

Referring still to FIGS. 11 and 12, the outer fixed lobe 54 and/or the outer movable lobe 94 may include ramps 56, 96 formed on an exterior portion thereof. The ramps 56, 96 may facilitate engagement of the workpiece 150 in the flat engaging position 164 or the corner engaging position 166. In this regard, the ramps 56, 96 may facilitate receipt of the workpiece 150 into the wrench opening 110 by facilitating lateral movement of the movable jaw set 80 as the outer fixed lobe 54 and the outer movable lobe 94 spread apart due to contact with the workpiece 150. Upon engagement of the workpiece 150 in the flat engaging position 164 as illustrated in FIG. 11, rotation of the head portion 12 in the direction of rotation R may result in reactive forces F generated between the outer and inner fixed lobes 54, 52 and the workpiece 150.

Conversely, as illustrated in FIG. 12, engagement of the workpiece 150 in the corner engaging position 166 and rotation of the head portion 12 in the direction indicated by the direction rotation R may result in reactive forces F between the outer and inner movable lobes 94, 92 and the workpiece 150. The lobes 94, 92 may be configured to facilitate engagement of the head portion 12 to the workpiece 150 such that opposing corners 154 of the workpiece 150 may be nested within the opposing pair of notches 116 formed by the adjacent pairs of lobes 52, 54, 92, 94 on each of opposing sides of the wrench opening 110. The inner portion 112 of the wrench opening 110 may be sized and configured to provide clearance with the workpiece 150 to facilitate engagement of the workpiece 150 corners 154 within the notches 116. As was earlier indicated, a non-perpendicular orientation of the handle axis H relative to the workpiece axis 156 may prevent engagement of the head portion 12 to the workpiece 150 in the corner engaging position 166 as a result of the fixed jaw spacing $S_f$ between the first and second fixed jaws 42, 44 and/or as a result of the movable jaw spacing $S_m$ between the first and second movable jaws 82, 84. However, it is contemplated that the inner and outer fixed and movable lobes 52, 54, 92, 94 may be configured to allow for non-perpendicular or off-axis engagement of the head portion 12 to the workpiece 150 in the corner engaging position 166.

Referring now to FIGS. 13-16, shown is the head portion 12 in an alternative embodiment wherein the fixed and movable jaw sets 40, 80 are sized and configured to prevent engagement of the workpiece 150 in the flat engaging position 164 and allow engagement of the workpiece 150 in the corner engaging position 166. The first and second movable jaws 82, 84 of the movable jaw set 80 may be configured to be laterally movable in a manner as described above with regard to the embodiments illustrated in FIGS. 1-10. In the embodiment shown in FIGS. 13-16, the first and second movable jaws 82, 84 of the movable jaw set 80 may respectively include the inner movable lobe 92 and the outer movable lobe 94. The fixed jaw set 40 may include the first and second fixed jaws 42, 44 respectively including the inner fixed lobe 52 and the outer fixed lobe 54. As shown in FIGS. 13-16, the pairs of fixed and movable jaws 42, 44, 82, 84 define the wrench opening 110 which may allow for engagement of the workpiece 150 in the corner engaging position 166 in a manner described above with regard to FIGS. 8-9.

Figure 13:
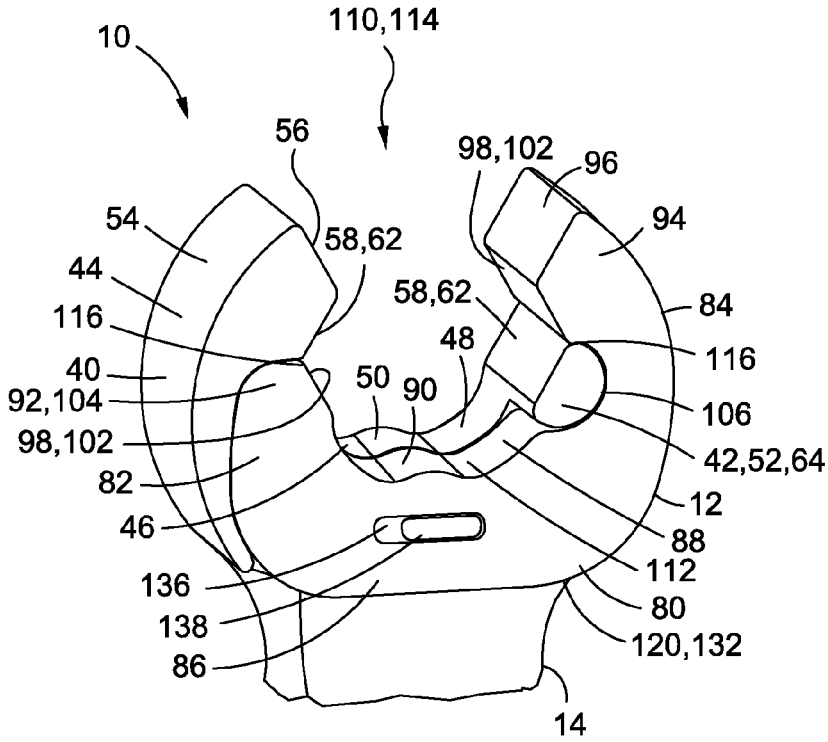
FIG. 13 is a perspective illustration of an embodiment of the wrench wherein the fixed and movable jaws are configured to limit engagement of the workpiece to the corner engaging position and prevent engagement of the workpiece in the flat engaging position.
Figure 14:
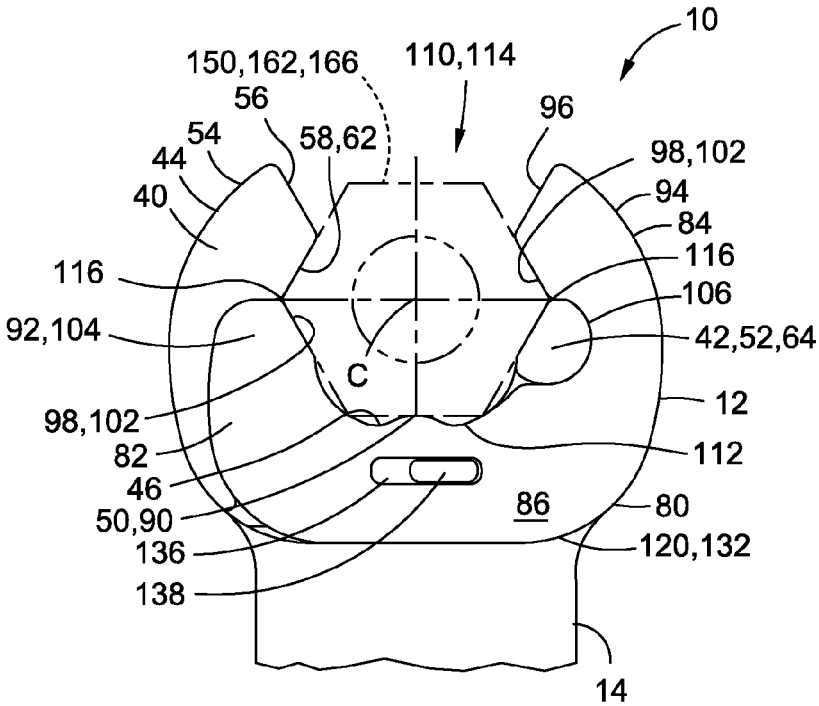
FIG. 14 is a front illustration of the head portion illustrating engagement of the planar surfaces of the lobes to the workpiece in the corner engaging position.
Figure 15:
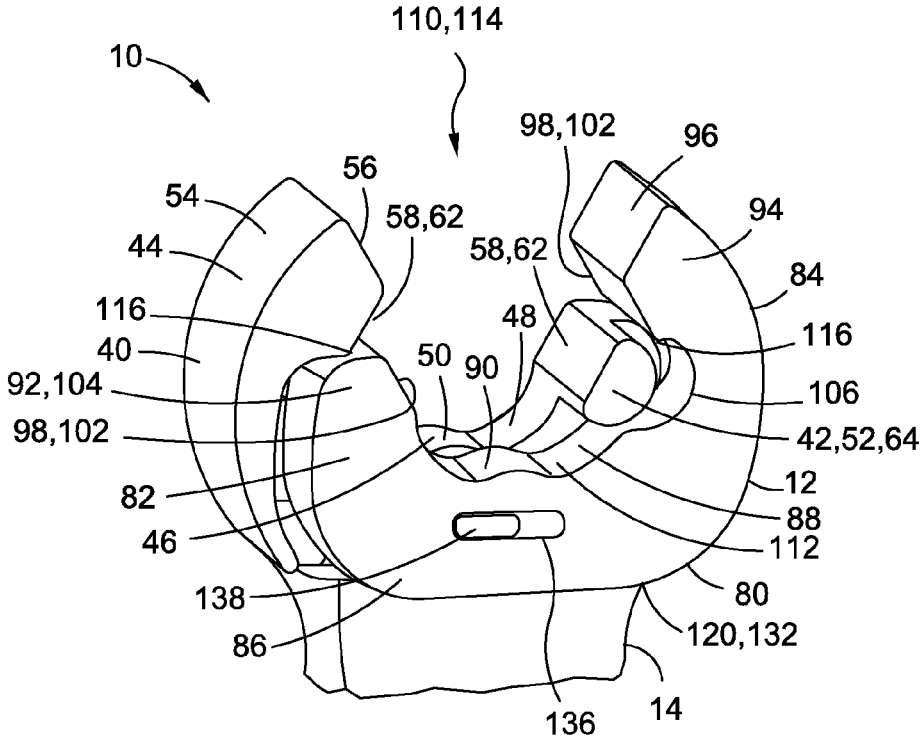
FIG. 15 is a perspective illustration of the head portion of FIG. 13 illustrating the movable jaws being laterally displaced relative to the fixed jaws and further illustrating the head portion preventing engagement of the workpiece in the flat engaging position.

For example, as shown in FIGS. 13-14, at least one of the engagement areas 58, 98 of the inner and outer fixed and movable lobes 52, 54, 92, 94 may include planar surfaces 62, 102 which may be sized and configured complementary to the flats 152 of the workpiece 150 in the corner engaging position 166. The inner and outer fixed and movable lobes 52, 54, 92, 94 may alternatively include rounded surfaces 60, 100 in the engagement areas 58, 98 that allow for engaging the workpiece 150 in the corner engaging position 166 but prevent engagement of the workpiece 150 in the flat engaging position 164 as shown in FIGS. 15-16. As mentioned above, engagement of the workpiece 150 in the flat engaging position 164 to the extent necessary to apply rotation and/or torque to the workpiece 150 may require engagement of the inner and outer lobes 52, 54, 92, 94 of either the fixed or movable jaw sets 40, 80 to an opposing set of the flats 152. Due to the configuration of the fixed and movable jaw sets 40, 80 as shown in FIGS. 15-16, at least one of the pair of fixed and movable jaws 40, 80 may be configured to prevent engagement of the workpiece 150 to the extent necessary to rotate the workpiece 150. In this regard, the spacing between the pairs of fixed and movable jaws 40, 80 may prevent engagement to the workpiece 150 in the flat engaging position 164.

Referring briefly to FIGS. 13-14, the wrench opening 110 may include an inner portion 112 defined by the fixed jaw web 46 and/or the movable jaw web 86. The fixed jaw web 46 and/or the movable jaw web 86 may include one or more protrusions 50, 90 which may be configured to engage a lowermost one of the flats 152 when the workpiece 150 is installed within the wrench opening 110 in the corner engaging position 166 as illustrated in FIG. 14. The protrusions 50, 90 may provide an additional area for seating the workpiece 150 within the wrench opening 110 and/or for facilitating the application of rotational force to the workpiece 150.

Referring to FIGS. 13-16, at least one of the outer fixed and outer movable lobes 54, 94 may include ramps 56, 96 for facilitating engagement of the workpiece 150 into the wrench opening 110 in a manner as was described above with regard to FIGS. 11-12. Furthermore, the fixed and movable jaw sets 40, 80 as shown in FIGS. 13-16 may be configured to maintain a substantially perpendicular orientation of the handle axis H to the workpiece axis 156 as illustrated in FIGS. 1-2. Advantageously, such substantially perpendicular orientation of the handle axis H relative to the workpiece axis 156 may facilitate the accurate application of torque to the workpiece 150.

Referring still to FIGS. 13-16, the fixed and movable jaw sets 40, 80 may include the sliding mechanism 120 to facilitate lateral movement of the movable jaw set 80 relative to the fixed jaw set. The sliding mechanism 120 may be configured in any suitable arrangement including, but not limited to, the web groove 122 arrangement illustrated in FIGS. 4-10 and described above. In the sliding mechanism 120 illustrated in FIGS. 13-16, the extent of travel of the movable jaw set 80 relative to the fixed jaw set 40 may be controlled by means of a slot 136 which may be formed in the movable jaw set 80. The slot 136 may be sized and configured to receive a projection 138 which may be formed with the fixed jaw set 40. The projection 138 may extend from the fixed jaw set 40 into the slot 136 and may be configured to be slidable along the slot 136.

As shown in FIGS. 13-16, the projection 138 may be movable between extreme ends of the slot 136 in correspondence with lateral movement of the movable jaw set 80. For example, the projection 138 may contact one end of the slot 136 when the movable jaw set 80 is moved to a position allowing entrance of the workpiece 150 into the wrench opening 110 as shown in FIGS. 13-14. The projection 138 may contact an opposite end of the slot 136 when the movable jaw set 80 is moved in an opposite direction such as into alignment with the fixed jaw set 40 as shown in FIGS. 15-16. As may be appreciated, the sliding mechanism 120 illustrated in FIGS. 13-16 is representative of one of many embodiments and is not to be construed as limiting alternative arrangement for facilitating lateral movement of the movable jaw set 80. For example, the sliding mechanism 120 may comprise the combination of web grooves 122 formed in the fixed jaw set 40 and movable jaw set 80 as illustrated in FIGS. 4-5. The fixed and movable jaw sets 40, 80 illustrated in FIGS. 13-16 may optionally include the biasing mechanism 132 similar to that which is illustrated in FIGS. 4-5 and described above. For example, the biasing mechanism 132 may comprise a compression spring 134 or other biasing member for urging the movable jaw set 80 into alignment with the fixed jaw set 40 during engagement of the workpiece 150 within the wrench opening 110. A variety of alternative configurations of the sliding mechanism 120 and biasing mechanism 132 may be incorporated into the wrench 10 embodiment illustrated in FIGS. 13-16.

Figure 18:
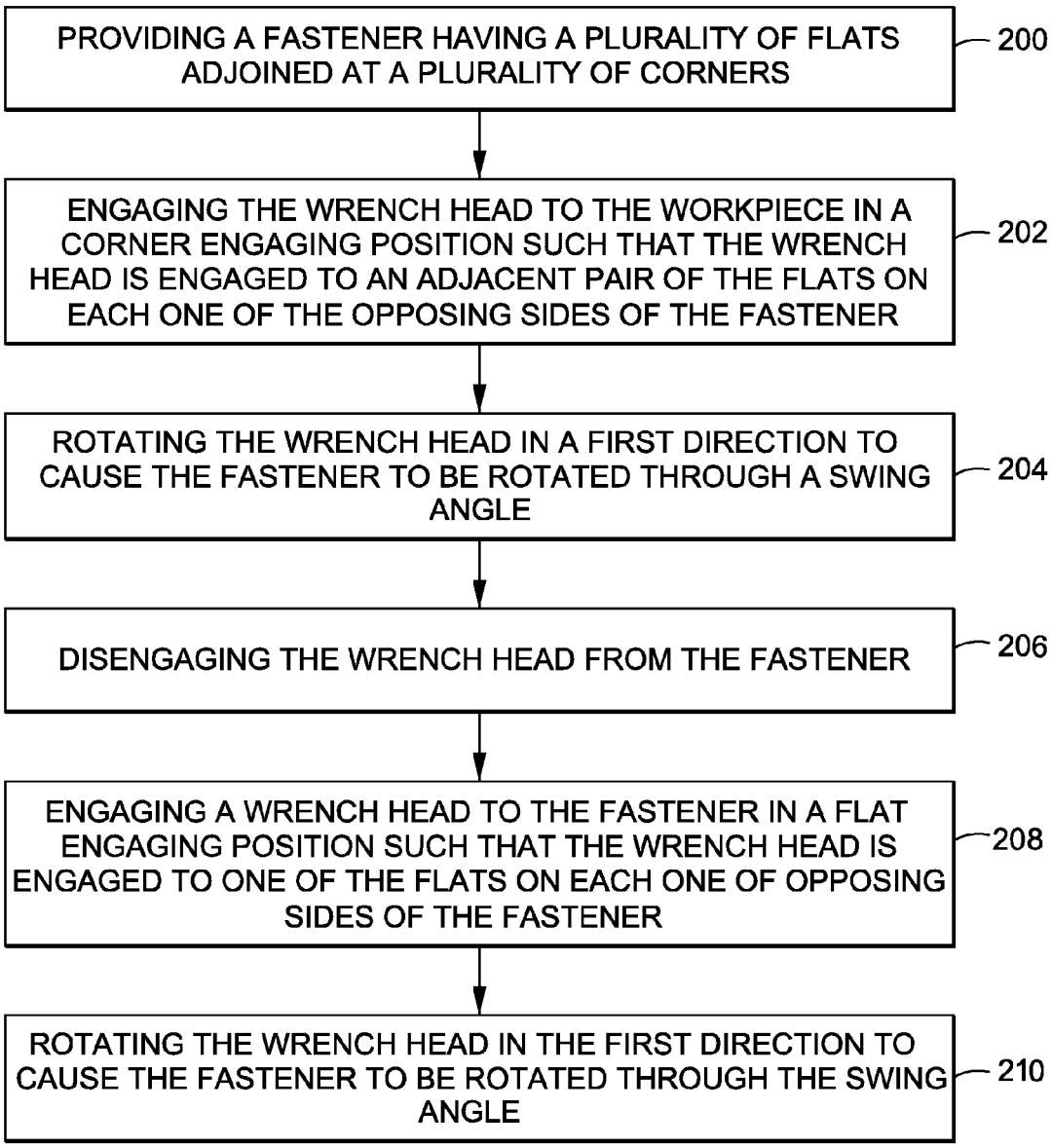
FIG. 18 is a flow diagram illustrating a methodology for rotating the workpiece.

Referring to FIGS. 17A-17O and FIG. 18, shown are a series of front views of the head portion 12 and workpiece 150 illustrating a process or methodology by which the head portion 12 may engage the workpiece 150 for repeated progressive rotation of the workpiece 150. As indicated above, the workpiece 150 may be provided in Step 200 with a plurality of flats 152 adjoined at a plurality of corners 154. Although the workpiece 150 is described as a fastener 162 for purposes of illustrating the methodology illustrated by the flow diagram of FIG. 18, the workpiece 150 may be provided in any one of a variety of configurations and is not limited to a fastener 162 configuration. In Step 202 of the methodology, the head portion 12 may be engaged to the fastener 162 in the corner engaging position 166. For example, in FIG. 17A, the head portion 12 may be moved toward the workpiece 150. The first and second fixed and movable jaw sets 42, 44, 82, 84 are shown as being generally aligned with one another. In this regard, the wrench 10 may optionally include the biasing mechanism 132 which may urge the movable jaw set 80 into alignment with the fixed jaw set 40. However, the fixed and movable jaw sets 40, 80 may be non-aligned with one another when the head portion 12 is moved toward the workpiece 150.

Figure 17B:
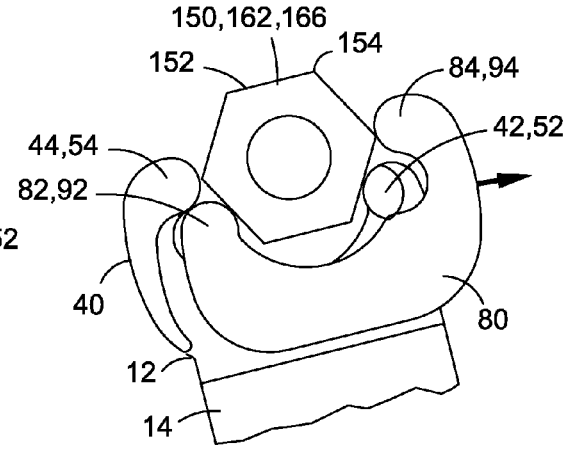
Figure 17C:
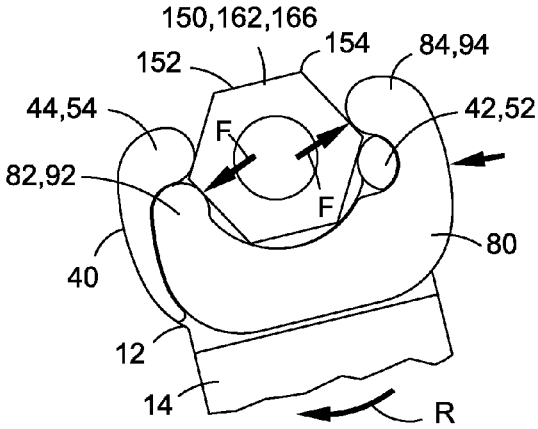

In FIG. 17B, the movable jaw set 80 may move laterally relative to the fixed jaw set 40 along a direction indicated by the arrow as the workpiece 150 is received into outer portion 114 of the wrench opening 110. The outer movable lobe 94 may move along the flat 152 of the fastener 162 and pass over the corner 154 of the fastener 162 as the fastener 162 moves into the wrench opening 110. In FIG. 17C, the movable jaw set 80 may move along the direction indicated by the arrow in FIG. 17B as the movable outer lobe follows the flat 152 of the fastener 162 until the movable jaw set 80 is aligned with the fixed jaw set 40. As indicated above, such movement of the movable jaw set 80 back into alignment with the fixed jaw set 40 may be facilitated by the biasing mechanism 132 described above and illustrated in FIGS. 4-5.

Figure 17D:
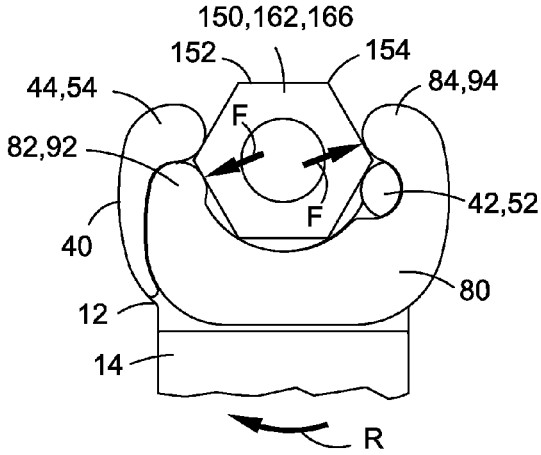
Figure 17E:
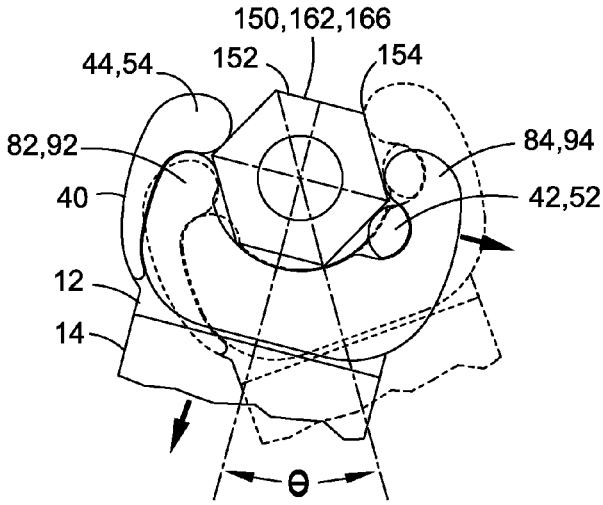

As can be seen in FIGS. 17C-17D, in the corner engaging position 166, the inner fixed lobe 52 and outer movable lobe 94 may be engaged to a pair of the flats 152 adjoined by one of the corners 154 on one side of the wrench opening 110. The outer fixed lobe 54 and inner movable lobe 92 may also be engaged to a pair of flats 152 on an opposite side of the wrench opening 110. The wrench 10 may be rotated along a direction of rotation indicated by the reference character R. In Step 204 of FIG. 18, the head portion 12 may be rotated along a first direction of rotation such as the direction of rotation R illustrated in FIG. 17D causing the fastener 162 to be rotated. The application of rotational force to the head portion 12 along the direction of rotation R may result in the reactive forces F at the outer movable lobe 94 and inner movable lobe 92. The orientation of the wrench 10 in FIG. 17A is superimposed over the orientation of the wrench 10 in FIG. 17E to illustrate the swing angle θ through which the fastener 162 may be rotated.

Figure 17F:
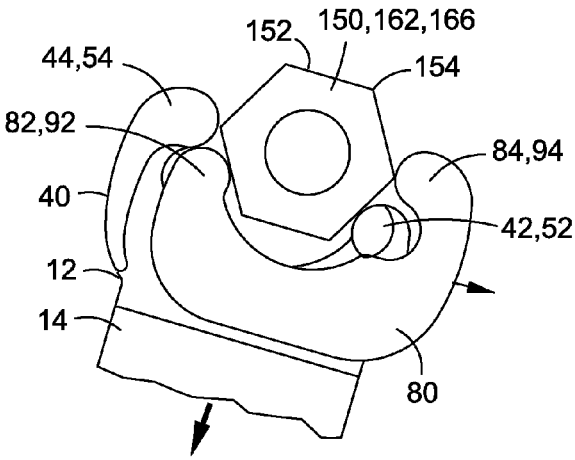
Figure 17G:
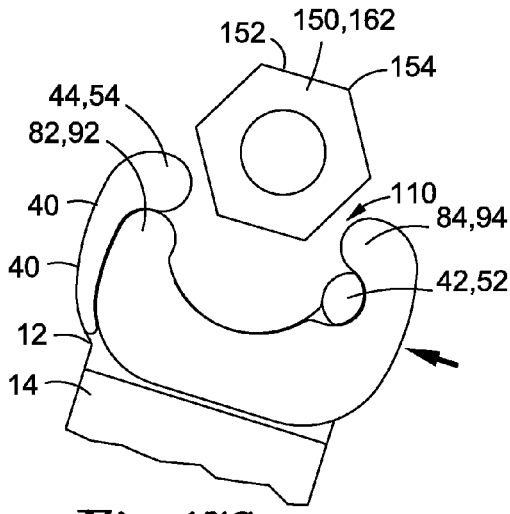
Figure 17H:
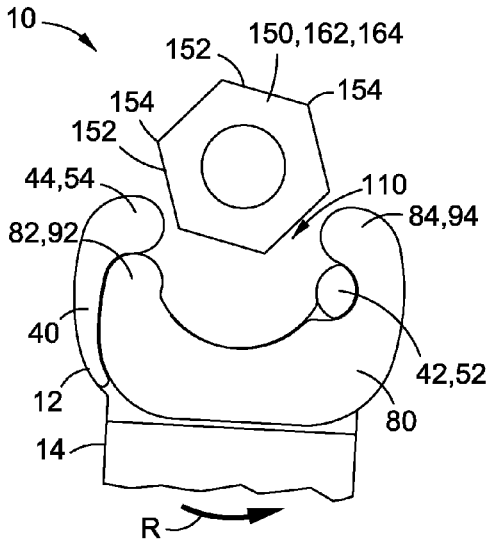
Figure 17I:
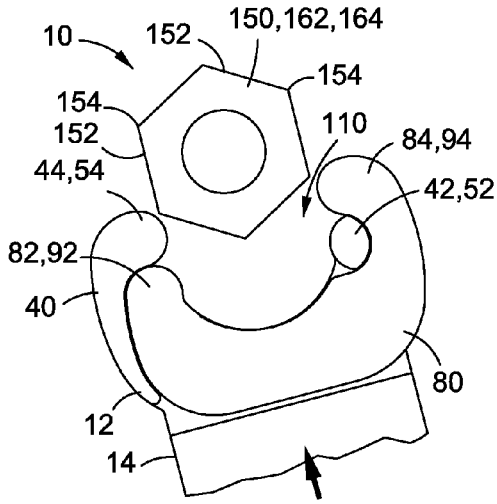

In FIG. 17E, the head portion 12 may be disengaged from the fastener 162 in Step 206 wherein the head portion 12 may be moved along the direction indicated by the arrow. The movable jaw set 80 may also simultaneously move laterally such that the outer movable lobe 94 may move over the corner 154 as shown in FIG. 17F. In FIG. 17G, the biasing mechanism 132 may urge the movable jaw set 80 back into alignment with the fixed jaw set 40 after the head portion 12 is disengaged from the fastener 162. In FIG. 17H, the head portion 12 may be rotated along a direction R opposite the direction of rotation shown in FIG. 17D in order to re-orient the head portion 12 at the same angle relative to the fastener 162 as illustrated in FIG. 17A. In Step 208, the head portion 12 may be moved toward the fastener 162 to engage the workpiece 150 in the flat engaging position 164 as shown in FIG. 17I.

Figure 17J:
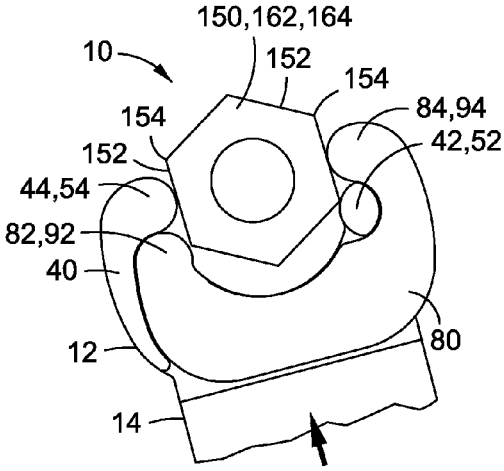
Figure 17K:
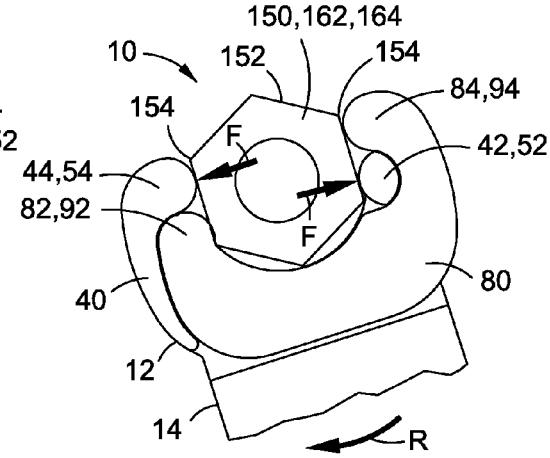
Figure 17L:
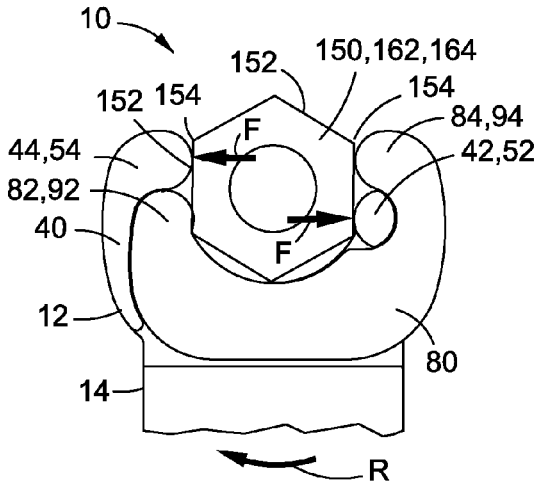

As can be seen in FIGS. 171-17J, the fixed jaw set 40 and movable jaw set 80 may be aligned with one another such that the inner fixed lobe 52 and outer movable lobe 94 are engaged to a single one of the flats 152 on one side of the wrench opening 110. The outer fixed lobe 54 and inner movable lobe 92 are engaged to an opposite one of the flats 152 on an opposite side of the opening. With the fixed and movable jaw sets 40, 80 engaged to the fastener 162 in the flat engaging position 164 as shown in FIG. 17K, Step 210 of the methodology includes rotating the fastener 162 along the direction of rotation R as shown in FIG. 17L. Rotation of the wrench 10 may result in the occurrence of the reactive forces F at the outer fixed lobe 54 and inner fixed lobe 52.

Figure 17M:
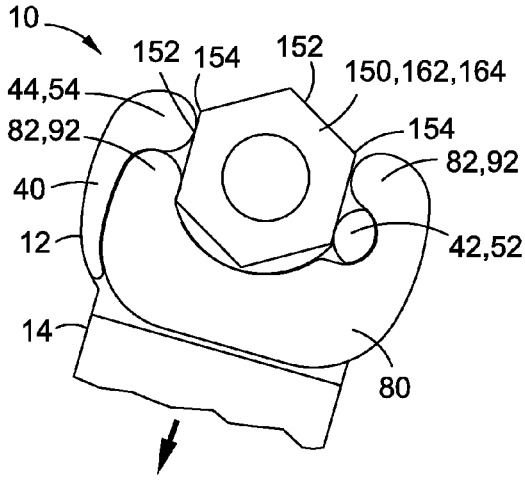
Figure 17N:
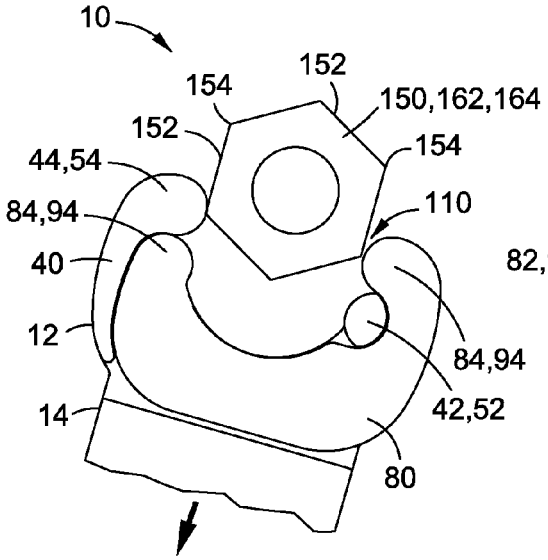
Figure 170:
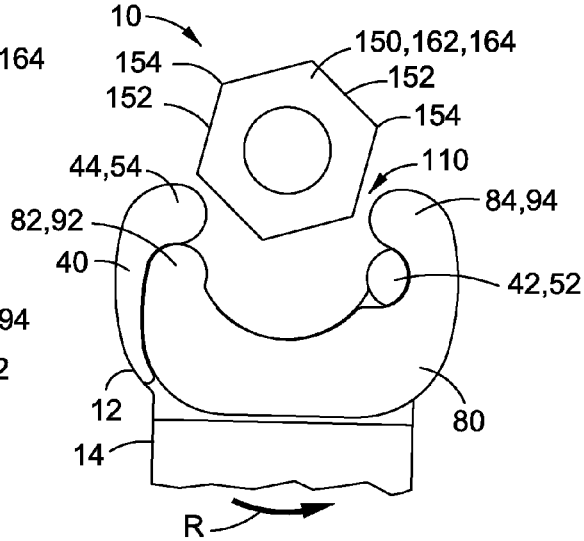

In FIG. 17M, the head portion 12 may be disengaged from the fastener 162 by moving the head portion 12 along the direction indicated by the arrow illustrated in FIG. 17M-17N. Following disengagement of the head portion 12 from the fastener 162 in FIG. 17O, the head portion 12 may be rotated in an opposite direction from that shown in FIG. 17L in order to re-orient the head portion 12 into position for engaging the fastener 162 in the corner engaging position 166 shown in FIG. 17A. The process may be repeated any number of times in order to rotate the workpiece 150 a desired amount.

A methodology for rotating the wrench 10 embodiment illustrated in FIGS. 13-16 includes successively engaging and rotating the workpiece 150 in the corner engaging position 166. As indicated above, FIGS. 13-16 illustrate the embodiment of the head portion 12 wherein the fixed and movable jaw sets 40, 80 may engage the workpiece 150 in the corner engaging position 166 but prevent engagement of the workpiece 150 in the flat engaging position 164 as shown in FIG. 16. The methodology for rotating the workpiece 150 may comprise engaging the head portion 12 to the workpiece 150 in the corner engaging position 166. The head portion 12 may then be rotated along a desired direction (i.e., clockwise or counter-clockwise) to cause the fastener 162 to be rotated. The head portion 12 may then be disengaged from the workpiece 150 and may rotated in a reverse direction and re-engaged to the workpiece 150 in the corner engaging position 166. As indicated above, the fixed and movable jaw sets 40, 80 of the head portion 12 are preferably configured such that orientation of the head portion 12 in a non-perpendicular relation to the workpiece axis 156 prevents engagement of the head portion 12 to the workpiece 150 in the corner engaging position 166.

A methodology for rotating the wrench 10 embodiment illustrated in FIG. 10 includes alternately rotating the workpiece 150 and flipping the wrench 10 about the handle axis H. As indicated above, in the wrench 10 embodiment illustrated in FIG. 10, the handle axis H is angularly offset relative to the opening axis O of the wrench opening 110. The methodology of rotating the workpiece 150 may include flipping the wrench 180 degrees about the handle axis H following disengagement of the head portion 12 from the workpiece 150 and then re-engaging the head portion 12 to the workpiece 150. Depending upon whether the head portion 12 is configured to engage the workpiece 150 in both the flat and corner engaging positions 164, 166 or whether the head portion 12 is limited to engaging the workpiece 150 in the corner engaging position 166, the methodology of rotating the workpiece 150 may include flipping the wrench 180 degrees about the handle axis H following each engagement and rotation step.

Figure 19:
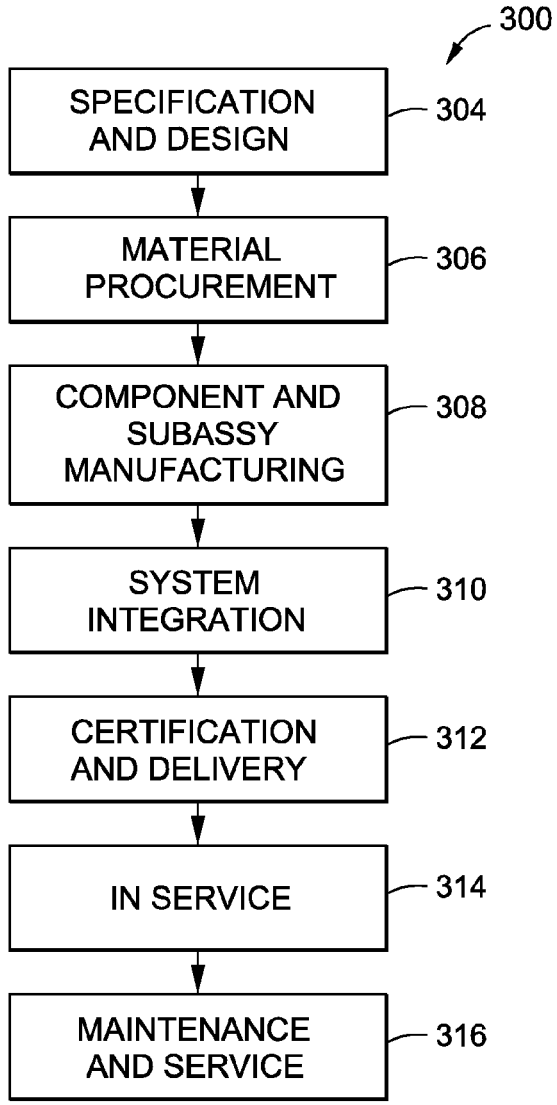
FIG. 19 is a flow diagram of an aircraft production and service methodology.
Figure 20:
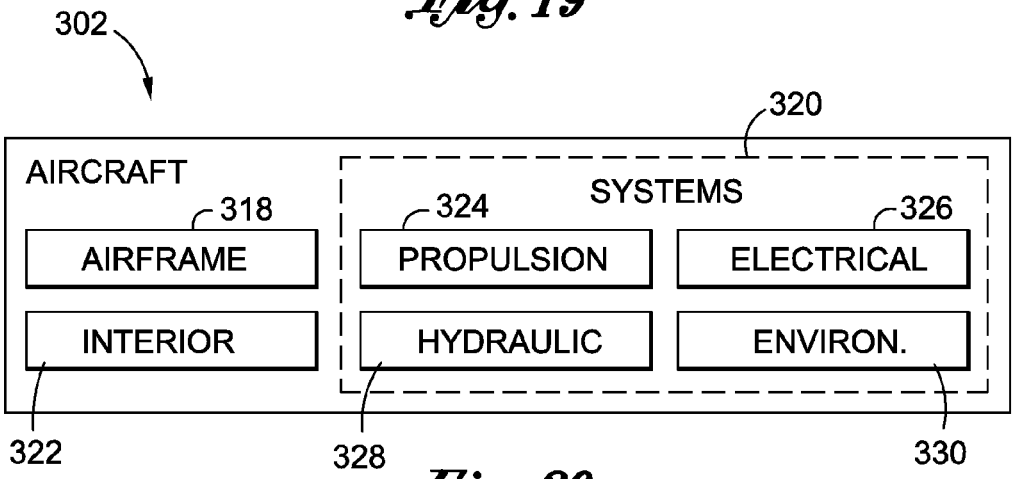
FIG. 20 is a block diagram of an aircraft.

Referring to FIGS. 19-20, embodiments of the disclosure may be described in the context of an aircraft manufacturing and service method 300 as shown in FIG. 19 and an aircraft 302 as shown in FIG. 20. During pre-production, exemplary method 300 may include specification and design 304 of the aircraft 302 and material procurement 306. During production, component and subassembly manufacturing 308 and system integration 310 of the aircraft 302 takes place. Thereafter, the aircraft 302 may go through certification and delivery 312 in order to be placed in service 314. While in service by a customer, the aircraft 302 is scheduled for routine maintenance and service 316 (which may also include modification, reconfiguration, refurbishment, and so on).

Each of the processes of method 300 may be performed or carried out by a system integrator, a third party, and/or an operator (e.g., a customer). For the purposes of this description, a system integrator may include without limitation any number of aircraft manufacturers and major-system subcontractors; a third party may include without limitation any number of vendors, subcontractors, and suppliers; and an operator may be an airline, leasing company, military entity, service organization, and so on.

As shown in FIG. 20, the aircraft 302 produced by exemplary method 300 may include an airframe 318 with a plurality of systems 320 and an interior 322. Examples of high-level systems 320 include one or more of a propulsion system 324, an electrical system 326, a hydraulic system 328, and an environmental system 330. Any number of other systems may be included. Although an aerospace example is shown, the principles of the disclosed embodiments may be applied to other industries, such as the automotive industry.

Apparatus and methods embodied herein may be employed during any one or more of the stages of the production and service method 300. For example, components or subassemblies corresponding to production process 308 may be fabricated or manufactured in a manner similar to components or subassemblies produced while the aircraft 302 is in service. Also, one or more apparatus embodiments, method embodiments, or a combination thereof may be utilized during the production stages 308 and 310, for example, by substantially expediting assembly of or reducing the cost of an aircraft 302. Similarly, one or more of apparatus embodiments, method embodiments, or a combination thereof may be utilized while the aircraft 302 is in service, for example and without limitation, to maintenance and service 316.

Additional modifications and improvements of the present disclosure may be apparent to those of ordinary skill in the art. Thus, the particular combination of parts described and illustrated herein is intended to represent only certain embodiments of the present disclosure and is not intended to serve as limitations of alternative embodiments or devices within the spirit and scope of the disclosure.

What is claimed is:

1. A method of rotating a workpiece having a plurality of flats, the method comprising the steps of:

engaging a head portion to the workpiece in a flat engaging position such that the head portion is engaged to one of the flats on each one of opposing sides of the workpiece, the head portion having a pair of fixed jaws and a pair of movable jaws; and rotating the head portion to cause the workpiece to be rotated;

engaging the head portion to the workpiece in a corner engaging position by moving the pair of movable jaws laterally and non-pivotally relative to the pair of fixed jaws such that the head portion is engaged to an adjacent pair of the flats on each one of the opposing sides of the workpiece; and rotating the head portion to cause the workpiece to be rotated.

2. The method of claim 1 wherein the pair of fixed jaws respectively includes inner and outer fixed lobes, the pair of movable jaws respectively includes inner and outer movable lobes, the step of moving the pair of movable jaws laterally relative to the pair of fixed jaws comprising:

engaging the inner fixed lobe and outer movable lobe to one side of the workpiece; and engaging the outer fixed lobe and inner movable lobe to an opposite side of the workpiece.

3. The method of claim 1 wherein the head portion includes a wrench opening defining an opening axis, the head portion having a handle extending outwardly therefrom and defining a handle axis being angularly offset relative to the opening axis, the method further comprising the steps of:

flipping the wrench 180° about the handle axis following the step of rotating the head portion to cause the workpiece to be rotated; and engaging the head portion to the workpiece in the flat engaging position.

4. The method of claim 1 wherein:

the head portion includes a handle defining a handle axis;

the workpiece defining a workpiece axis;

the head portion being configured such that orientation of the handle axis in non-perpendicular relation to the workpiece axis prevents engagement of the head portion to the flats of the workpiece in the corner engaging position.

5. A method of rotating a fastener using a wrench having a head portion including pair of fixed jaws and a pair of movable jaws, the fastener having a plurality of flats adjoined at a plurality of corners, the method comprising the steps of:

engaging the head portion to the fastener in a corner engaging position by moving the pair of movable jaws laterally and non-pivotally relative to the pair of fixed jaws such that the head portion is engaged to an adjacent pair of the flats on each one of the opposing sides of the fastener;

rotating the head portion in a first direction to cause the fastener to be rotated through a swing angle;

disengaging the head portion from the fastener;

engaging the head portion to the fastener in a flat engaging position such that the head portion is engaged to one of the flats on each one of opposing sides of the fastener; and rotating the head portion in the first direction to cause the fastener to be rotated through the swing angle.

6. The method of claim 1 further comprising the step of:

urging the pairs of fixed and movable jaws into alignment with one another using a biasing mechanism.

7. The method of claim 1 wherein:

the workpiece defines a workpiece axis; and the pairs of fixed and movable jaws being configured such that orientation of the head portion in non-perpendicular relation to the workpiece axis prevents engagement of the head portion to the flats of the workpiece in the corner engaging position.

8. The method of claim 2 wherein:

the inner and outer fixed lobes and inner and outer movable lobes include engagement areas for engaging the workpiece; and at least one of the engagement areas being formed as one of a planar surface and a rounded surface.

* * * * *